US008613161B2

(12) United States Patent
Nicholson et al.

(10) Patent No.: US 8,613,161 B2
(45) Date of Patent: Dec. 24, 2013

(54) REFRIGERATOR DOOR CONSTRUCTION INCLUDING A LAMINATED PACKAGE

(75) Inventors: Jeffery W. Nicholson, Palmdale, CA (US); Paul J. Artwohl, Flossmoor, IL (US); Donald J. Sokol, Valencia, CA (US)

(73) Assignee: Anthony, Inc., Sylmar, CA (US)

( * ) Notice: Subject to any disclaimer, the term of this patent is extended or adjusted under 35 U.S.C. 154(b) by 900 days.

(21) Appl. No.: 12/195,236

(22) Filed: Aug. 20, 2008

(65) Prior Publication Data

US 2010/0043293 A1 Feb. 25, 2010

(51) Int. Cl.
*E06B 3/00* (2006.01)

(52) U.S. Cl.
USPC ..... 49/501; 49/236; 312/116

(58) Field of Classification Search
USPC ..... 49/236, 237, 501, 504; 16/250, 303, 16/312, 317, 318, 341, 342; 312/116, 312/138.1, 326, 327
See application file for complete search history.

(56) References Cited

U.S. PATENT DOCUMENTS

| | | | | |
|---|---|---|---|---|
| 1,913,703 | A | | 6/1933 | D'Adrian |
| 2,497,507 | A | | 2/1950 | McMaster |
| 2,650,976 | A | | 9/1953 | Gaiser |
| 2,711,789 | A | | 6/1955 | Boyle |
| 2,858,408 | A | | 10/1958 | Barroero |
| 3,628,845 | A | | 12/1971 | Grimm |
| 3,629,554 | A | | 12/1971 | Stewart |
| 3,648,327 | A | | 3/1972 | Edeus |
| 3,655,939 | A | | 4/1972 | Stromquist |
| 3,710,074 | A | | 1/1973 | Stewart |
| 3,721,594 | A | | 3/1973 | Tarnopol |
| 3,724,129 | A | | 4/1973 | Stromquist |
| 3,760,157 | A | | 9/1973 | Newman |
| 3,772,075 | A | | 11/1973 | Tarnopol |
| 3,780,472 | A | * | 12/1973 | Biebuyck ..... 49/501 |
| 3,838,234 | A | | 9/1974 | Peterson |
| 3,859,502 | A | | 1/1975 | Heaney |
| 3,892,947 | A | | 7/1975 | Strengholt |

(Continued)

OTHER PUBLICATIONS

D. M. Rowe et al., IECEC-98-024—33d Intersociety Energy Conversion Engineering Conference, Colorado Springs, CO, Aug. 2-6, 1998.

(Continued)

*Primary Examiner* — Katherine Mitchell
*Assistant Examiner* — Catherine A Kelly
(74) *Attorney, Agent, or Firm* — Jeffer Mangels Butler & Mitchell LLP

(57) ABSTRACT

A door assembly that includes a a frame having an upper portion and a lower portion, an electrical hinge mounted to the upper portion of the frame, a gravity hinge mounted to the lower portion of the frame and a door pivotably mounted to the frame by the electrical hinge and the gravity hinge. The electrical hinge pin has a hinge pin part having a plurality of electrical conductors extending downwardly therefrom. The gravity hinge also includes a hinge pin part. The door includes a laminated package having first, second and third layers adhered to one another. At least one of the layers includes an electro-conductive coating thereon that is in electrical communication with the electrical hinge. The door also includes a rail secured adjacent a hinge side edge of the laminated package. The rail includes a tunnel defined therein that includes a top opening that receives the hinge pin part of the electrical hinge and a bottom opening that receives the hinge pin part of the gravity hinge.

11 Claims, 22 Drawing Sheets

(56) References Cited

U.S. PATENT DOCUMENTS

| | | | | |
|---|---|---|---|---|
| 3,902,040 | A | 8/1975 | Ikeda | |
| 3,911,245 | A | 10/1975 | O'Shaughnessy | |
| 4,035,608 | A | 7/1977 | Stromquist | |
| 4,127,765 | A | 11/1978 | Heaney | |
| 4,206,615 | A | 6/1980 | Sobajima | |
| 4,248,015 | A | 2/1981 | Stromquist | |
| 4,260,876 | A | 4/1981 | Hochheiser | |
| 4,278,875 | A | 7/1981 | Bain | |
| 4,306,140 | A | 12/1981 | Stromquist | |
| 4,325,227 | A | 4/1982 | Ibrahim | |
| 4,631,777 | A | 12/1986 | Takimoto | |
| 4,637,167 | A | 1/1987 | Svensson | |
| 4,658,553 | A | 4/1987 | Shinagawa | |
| 4,671,582 | A * | 6/1987 | Stromquist et al. | 439/31 |
| 4,691,486 | A | 9/1987 | Niekrasz | |
| 4,707,586 | A | 11/1987 | Voss | |
| 4,721,636 | A | 1/1988 | Hood | |
| 4,725,710 | A | 2/1988 | Lamus | |
| 4,733,504 | A | 3/1988 | Lindgren | |
| 4,876,178 | A | 10/1989 | Voss | |
| 4,940,297 | A | 7/1990 | Borgen | |
| 4,957,358 | A | 9/1990 | Terada | |
| 5,097,642 | A | 3/1992 | Richardson | |
| 5,099,104 | A | 3/1992 | Holzer | |
| 5,197,242 | A | 3/1993 | Baughman | |
| 5,255,473 | A | 10/1993 | Kaspar | |
| 5,329,736 | A | 7/1994 | Sodervall | |
| 5,363,611 | A * | 11/1994 | Richardson et al. | 312/116 |
| 5,414,240 | A | 5/1995 | Carter | |
| 5,418,025 | A | 5/1995 | Harmand | |
| 5,434,384 | A | 7/1995 | Koontz | |
| 5,493,102 | A | 2/1996 | Takase | |
| 5,750,267 | A | 5/1998 | Takase | |
| 5,778,689 | A | 7/1998 | Beatenbough | |
| 5,821,501 | A | 10/1998 | Zorn | |
| 5,852,284 | A | 12/1998 | Teder | |
| D418,608 | S | 1/2000 | Witte | |
| 6,014,840 | A | 1/2000 | Ray | |
| 6,042,948 | A | 3/2000 | Ogawa | |
| 6,051,820 | A | 4/2000 | Poix | |
| 6,144,017 | A | 11/2000 | Millett | |
| 6,260,255 | B1 | 7/2001 | Richardson | |
| 6,268,594 | B1 | 7/2001 | Leutner | |
| 6,301,913 | B1 | 10/2001 | Schulak | |
| 6,393,768 | B1 | 5/2002 | Roche | |
| 6,547,346 | B2 | 4/2003 | Topper | |
| 6,606,832 | B2 | 8/2003 | Richardson | |
| 6,606,833 | B2 * | 8/2003 | Richardson et al. | 52/204.5 |
| 6,609,350 | B1 | 8/2003 | Weber | |
| 6,668,499 | B2 * | 12/2003 | Degelsegger | 52/204.62 |
| 6,830,791 | B1 | 12/2004 | Misonou | |
| 6,953,911 | B2 * | 10/2005 | Bartrug et al. | 219/203 |
| 7,002,115 | B2 | 2/2006 | Gerhardinger | |
| 7,026,577 | B2 | 4/2006 | Maeuser | |
| 7,053,343 | B2 | 5/2006 | Gerhardinger | |
| 7,132,625 | B2 | 11/2006 | Voeltzel | |
| 7,241,964 | B2 | 7/2007 | Gerhardinger | |
| 7,265,323 | B2 | 9/2007 | Gerhardinger | |
| 7,362,491 | B2 | 4/2008 | Busick | |
| 7,429,091 | B2 * | 9/2008 | Reed et al. | 312/408 |
| 2002/0005398 | A1 | 1/2002 | Gillner | |
| 2002/0073725 | A1 | 6/2002 | Rand | |
| 2002/0078654 | A1 | 6/2002 | Richardson | |
| 2002/0152762 | A1 | 10/2002 | Petrenko | |
| 2003/0062813 | A1 | 4/2003 | Cording | |
| 2003/0087048 | A1 | 5/2003 | Chaussade | |
| 2003/0116551 | A1 | 6/2003 | Sol | |
| 2003/0197449 | A1 | 10/2003 | Cording | |
| 2003/0205059 | A1 | 11/2003 | Roche | |
| 2004/0065651 | A1 | 4/2004 | Voeltzer | |
| 2004/0194388 | A1 | 10/2004 | Roche | |
| 2004/0195233 | A1 | 10/2004 | Gerhardinger | |
| 2004/0214010 | A1 | 10/2004 | Murata | |
| 2004/0222724 | A1 | 11/2004 | Cording | |
| 2005/0045613 | A1 | 3/2005 | Maeuser | |
| 2005/0115954 | A1 | 6/2005 | Gerhardinger | |
| 2005/0202178 | A1 | 9/2005 | Roche | |
| 2005/0252908 | A1 | 11/2005 | Weiss | |
| 2005/0269312 | A1 | 12/2005 | Gerhardinger | |
| 2006/0005484 | A1 | 1/2006 | Riblier | |
| 2006/0026975 | A1 | 2/2006 | Bunch | |
| 2006/0127586 | A1 | 6/2006 | Roche | |
| 2006/0201932 | A1 | 9/2006 | Degand | |
| 2006/0265979 | A1 | 11/2006 | Cording | |
| 2007/0003700 | A1 | 1/2007 | Roche | |
| 2007/0077399 | A1 | 4/2007 | Borowiec | |
| 2007/0235441 | A1 | 10/2007 | Winsler | |
| 2007/0259137 | A1 | 11/2007 | Busick | |
| 2008/0035629 | A1 | 2/2008 | Thiry et al. | |
| 2008/0135543 | A1 | 6/2008 | Johnson | |

OTHER PUBLICATIONS

International Preliminary Report on Patentability by the International Bureau of WIPO on Feb. 22, 2011, issued in related PCT application.

Supplementary European Search Report, issued in related EPO Application EP09808559 on Aug. 28, 2012.

* cited by examiner

REFRIGERATOR DOOR CONSTRUCTION INCLUDING A LAMINATED PACKAGE

FIELD OF THE INVENTION

The present invention relates generally to door constructions, and in particular, those used for refrigerated display cases.

BACKGROUND OF THE INVENTION

Commercial refrigerators and refrigerated display cases (coolers and freezers) are used in markets, food vending operations, liquor stores and the like for preserving freshness and attractively displaying products to the consumer. Typically, such display cases have a refrigerated enclosure and an opening that is sealed by a door that the consumer can see through and open to retrieve the desired product.

At certain times, including when the doors are opened, the glass in the door tends to fog. Accordingly, a need has developed for an improved door construction that reduces fogging.

SUMMARY OF THE PREFERRED EMBODIMENTS

In accordance with a first aspect of the present invention there is provided a door assembly that includes a frame having an upper portion and a lower portion, an electrical hinge mounted to the upper portion of the frame, a gravity hinge mounted to the lower portion of the frame and a door pivotably mounted to the frame by the electrical hinge and the gravity hinge. The electrical hinge pin has a hinge pin part having a plurality of electrical conductors extending downwardly therefrom. The gravity hinge also includes a hinge pin part. The door includes a laminated package having first, second and third layers adhered to one another. At least one of the layers includes an electro-conductive coating thereon that is in electrical communication with the electrical hinge. The door also includes a rail secured adjacent a hinge side edge of the laminated package. The rail includes a tunnel defined therein that includes a top opening that receives the hinge pin part of the electrical hinge and a bottom opening that receives the hinge pin part of the gravity hinge. In a preferred embodiment, the door is pivotable between a closed position and an open position and there is a gap defined between the top of the rail and the frame. The door moves vertically when pivoted between the closed position and the open position, thereby reducing the dimension of the gap.

In accordance with another aspect of the present invention there is provided a gravity hinge that includes a lower portion and an upper portion. The lower portion includes a plate having an axial rod and a first cam track having a wedge shape extending upwardly therefrom. The plate includes an elongated opening defined therethrough. The upper portion includes a first cam track having a first open position peak and a first closed position peak. The upper portion also includes an opening defined therein that receives the axial rod. The first wedge shaped cam track is adapted to be received in either the first open position peak or the first closed position peak. In a preferred embodiment, the lower portion further includes a second cam track having a wedge shape extending upwardly from the plate, and the upper portion includes a second cam track having a second open position peak and a second closed position peak. The second wedge shaped cam track is adapted to be received in the second open position peak or the second closed position peak. The first and second wedge shaped cam tracks are preferably arranged about 180° apart circumferentially around the axial rod.

BRIEF DESCRIPTION OF THE DRAWINGS

The invention may be more readily understood by referring to the accompanying drawings in which:

FIG. 12 a is a cross sectional perspective view of the rail of the assembly of FIG. 1 with the access cover exploded out of the access opening;

Like numerals refer to like parts throughout the several views of the drawings and the specification.

DETAILED DESCRIPTION OF THE PREFERRED EMBODIMENTS

As shown in the accompanying drawings, the present invention is directed to a front assembly for a refrigerator display case, generally indicated as 12, that includes doors 31 having a laminated package 100 and that are movable between a closed position and an open position.

It will be appreciated that terms such as "front," "back," "top," "bottom," "left," "right," "above," "vertical" and "side" used herein are merely for ease of description and refer to the orientation of the components as shown in the figures. It should be understood that any orientation of the components described herein is within the scope of the present invention.

FIGS. 1-6 depict the front portion of a refrigerated display case incorporating four display case doors/door assemblies 31 in accordance with a preferred embodiment of the present invention. In FIGS. 1-6, the display case is omitted, but the frame 40 of the display case is shown to illustrate how the inventive doors 31 are affixed and hinged thereto. The display case frame 40 and door assemblies 31 are numbered together in the figures as 12.

Figure 7:
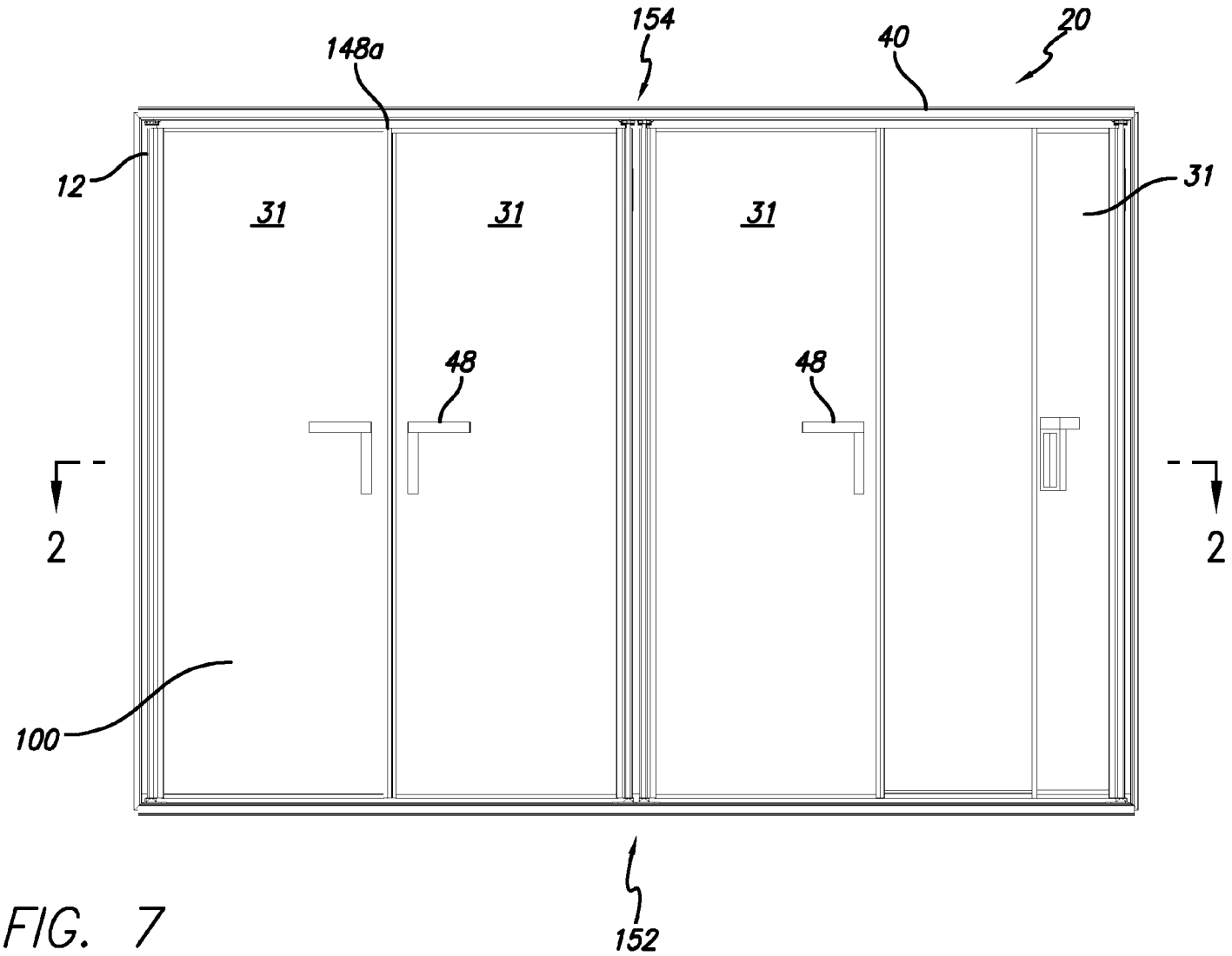
FIG. 7 is a front view of a display case that includes the assembly of FIG. 1.

As shown in FIG. 7, the display case 20 includes doors 31, mounted in surrounding frame 40 that defines an opening in the display case. Doors 31 have a laminated package (often referred to herein as single glass units or SGUs), generally depicted as 100. Glass panels 100 are designed to allow someone, such as a supermarket customer, to view display items on shelves (not shown). The display case 20 may or may not be refrigerated.

Using handles 48, doors 31 can be swung open or closed to alternately seal or unseal the interior space of display case. Typical display cases include numerous other structures for attaching doors 31 to the display case, as well as features for housing wiring, mullions 11, gaskets 13 and other associated brackets and components that are typically included in refrigerated display cases. These features and components are shown, for example, in FIGS. 2, 3 and 5 and are well known in the art and will not be discussed in detail herein. An example of such components are discussed in U.S. Pat. Nos. 6,606,832, and 6,606,833, the disclosures of which are incorporated by reference herein in their entireties.

Figure 8:
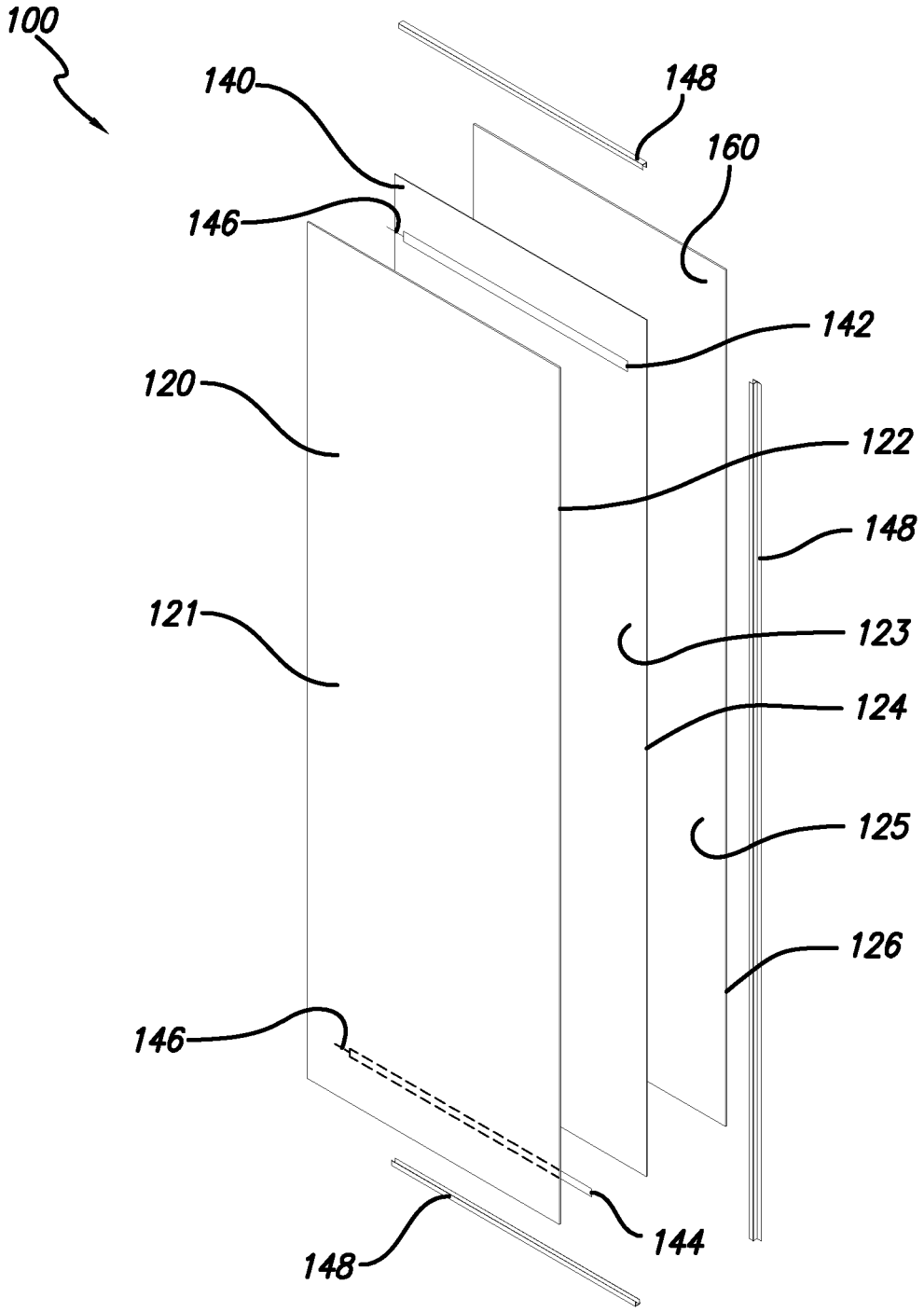
FIG. 8 is an exploded view of the single glass unit of the assembly of FIG. 1.
Figure 9:
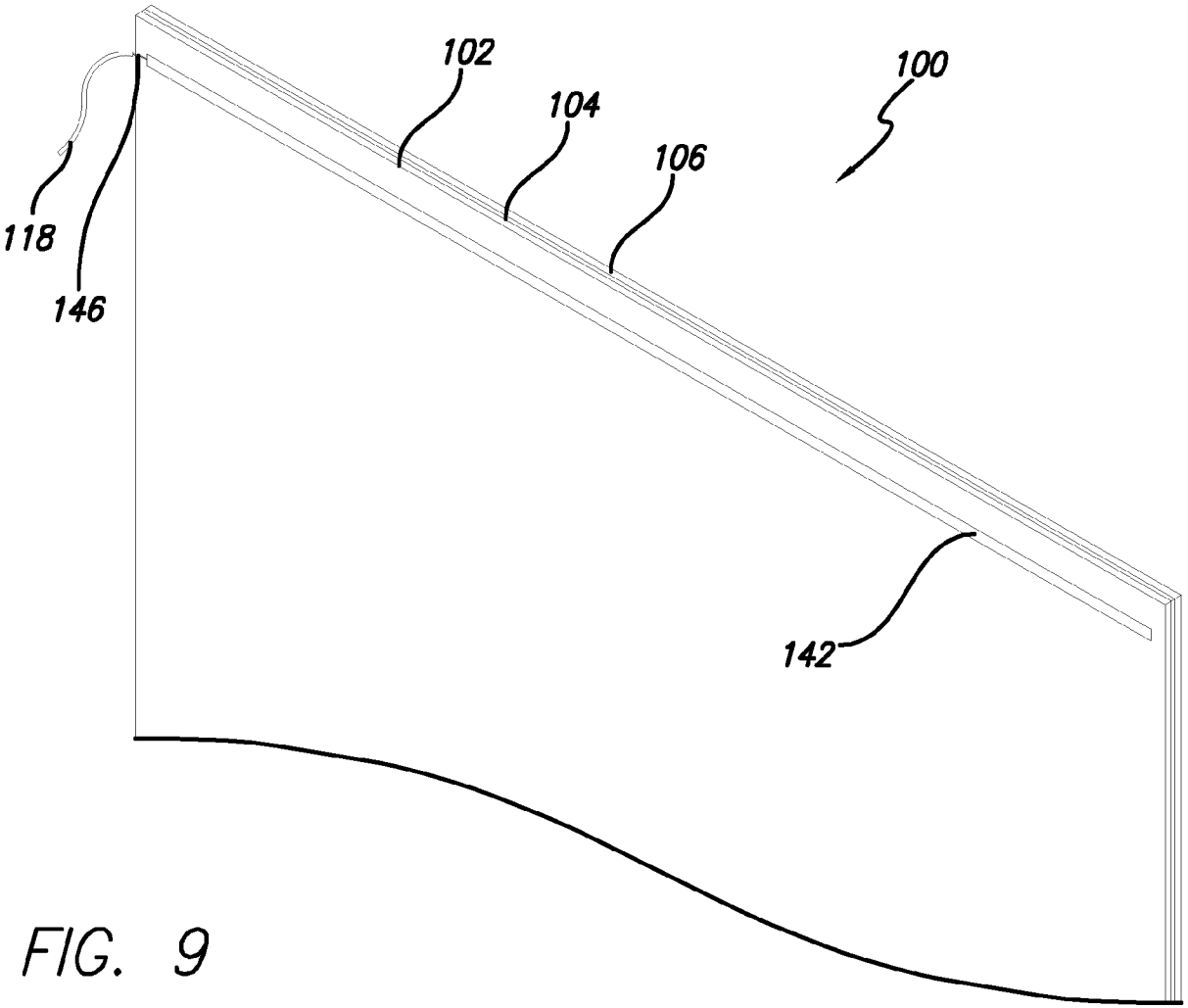
FIG. 9 is a perspective view of the single glass unit of the assembly of FIG. 1.

With reference to FIGS. 8-11, in a preferred embodiment, the single glass unit 100 is a laminated package that includes an electro-conductive coating or member that can heat the package to help prevent condensation or fogging. FIG. 8 is an exploded view of a preferred embodiment of a single glass unit 100 and FIG. 9 shows the layers laminated together. The single glass unit 100 preferably comprises first layer 120, layer 140 and third layer 160. Preferably, the first and third layers 120 and 160 are made of glass and the second/inner layer 140 is made of plastic, such as polyvinyl butyral or the like. However, more or fewer layers or different combinations of plastics and/or glass can be used. Any transparent material can be used.

Each layer has two/front and back surfaces, depicted as 121, 122, 123, 124, 125 and 126. In the embodiment of FIGS. 8-11, surface 121 faces the customer and surface 126 faces the interior space of the display case. The thickness of the unit 100 can be different for different applications. However, in an exemplary embodiment, such as the one shown in FIG. 3, the overall thickness of the unit 100 is preferably about 0.31", with the first and third layers 120 and 160 being about 0.125" thick and the second layer 140 being about 0.060" thick.

In a preferred embodiment, the electro-conductive coating is a pyrolitic coating or other hardcoat that is applied by spraying on surface 122. It will be appreciated by those skilled in the art that other electro-conductive coatings can be used and can be adhered, applied, laminated or the like onto surface 122 (and/or other surfaces) as desired. For example, a chemical vapor deposition technique can be used. However, this is not a limitation on the present invention.

To provide electricity to the coating, the SGU 100 preferably includes top and bottom bus bars 142 and 144, which are vertically spaced from one another and are adhered to the coating. FIG. 9 shows top bus bar 142 though transparent layer 120. Each bus bar 142 and 144 preferably includes a lead assembly or solder tab 146 for adhering wires or insulated conductors 118 that are in communication with an electrical source. With this arrangement, electrical power moves through one of the lead assemblies 146 to one bus bar 142 or 144, across the coating, to the other bus bar 142 or 144, and through the other lead assembly 146 to heat the SGU 100 to help prevent condensation.

In a preferred embodiment, layers 120, 140 and 160 are preferably designed to maximize visible light transmission from inside the case to the customer, thereby improving the ability of customers to view display items. However, it is also desirable to minimize the transmission of non-visible light (i.e., ultraviolet and infrared light) through glass unit 100 from outside to inside the case in order to improve thermal performance and to protect items therein. Coolers are a type of refrigerated display case which operate at a temperature of approximately 38° F. Freezers are another type of refrigerated display case which operate below 0° F. When the glass unit of such display cases comes into contact with ambient air, the relatively colder glass unit can cause moisture in the air to condense on the surfaces of the glass unit. Thus, besides the use of the electro-conductive coating described above, it is desirable to use the non-visible wavelengths of light to heat the glass panels, thus reducing or preventing condensation. The present invention provides a thermopane unit that appears as a single pane of glass. This exchanges the air space in prior art units for the second layer 140 (which is preferably plastic), which creates a thermobreak. In an embodiment with a plastic second layer 140, the single glass unit 100 provides better thermal properties than glass alone. And, the plastic laminate layer also adds safety by helping keeping the unit intact if breakage occurs. In a preferred embodiment, the plastic layer 140 can also include a UV inhibitor in the laminate, which can help increase the shelf life of products inside.

In an embodiment where reflection is an issue, an anti-reflective coating can be applied to the glass unit 100. In an exemplary embodiment, the anti-reflective coating can be applied on surfaces 121 and 126.

Prior techniques for improving thermal performance and reducing condensation (or reducing the heating needed to avoid condensation) involved the use of low emissivity hard coated glass panes. However, in order to achieve the desired performance, such hard coatings had to be applied to two of the six surfaces of glass panels that included air therebetween. The present invention results from the lamination of three layers that include an electro-conductive coating therein for heating the glass unit 100.

Figure 10:
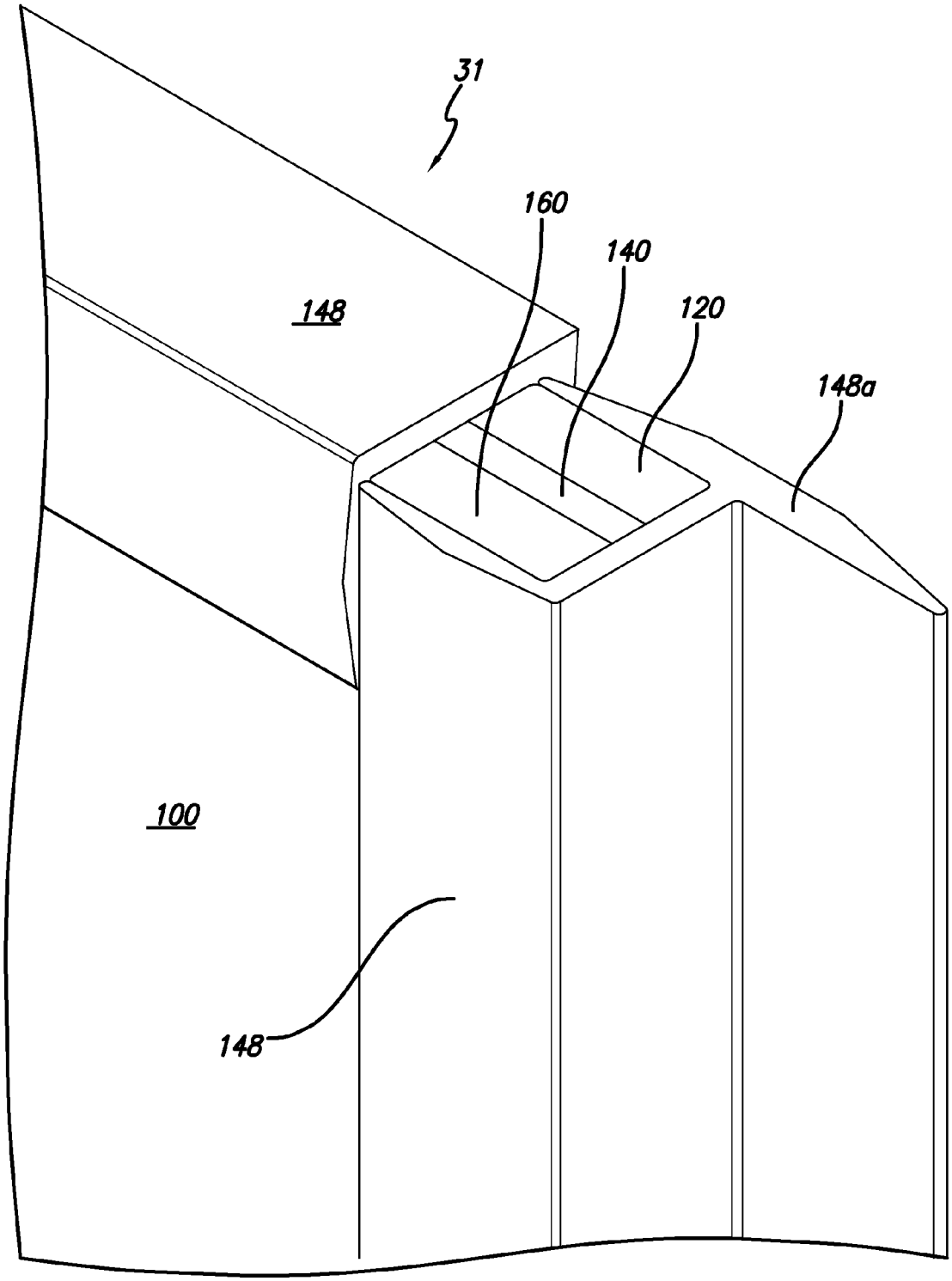
FIG. 10 is a perspective view of the single glass unit with edge guards thereon.
Figure 11:
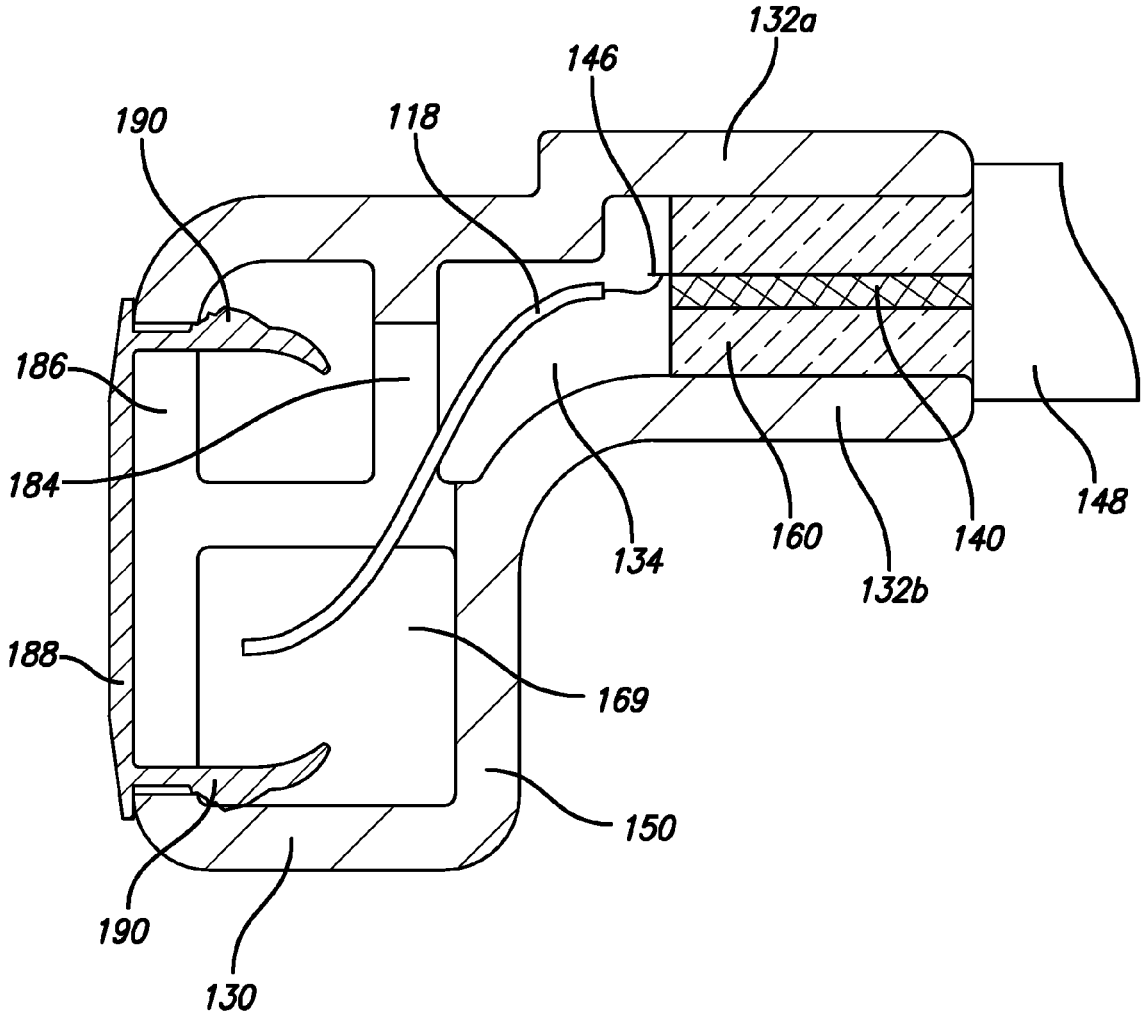
FIG. 11 is a cross sectional plan view of the rail of the assembly of FIG. 1.

In a preferred embodiment, to maximize the visibility through the door 31, and as shown in FIGS. 8, 10 and 11, the SGU 100 includes transparent edge guards/moldings 148. The edge guards 148 are preferably adhered to the top edge, bottom edge, and non-hinge side edge of the SGU 100. For example, silicon or the like could be used for bonding. The edge guards 148 provide a sealing feature and ensure that a person cannot come into contact with any electrically charged surfaces. Preferably, the edge guard 148 on the non-hinged edge of the SGU 100 includes a wiper **148*a* that cooperates with a wiper 148*a* on an opposite oriented door (e.g., left opening versus right opening) to seal the display case when the doors 31** are closed. In another embodiment, the edge guards can be omitted.

Figure 12:
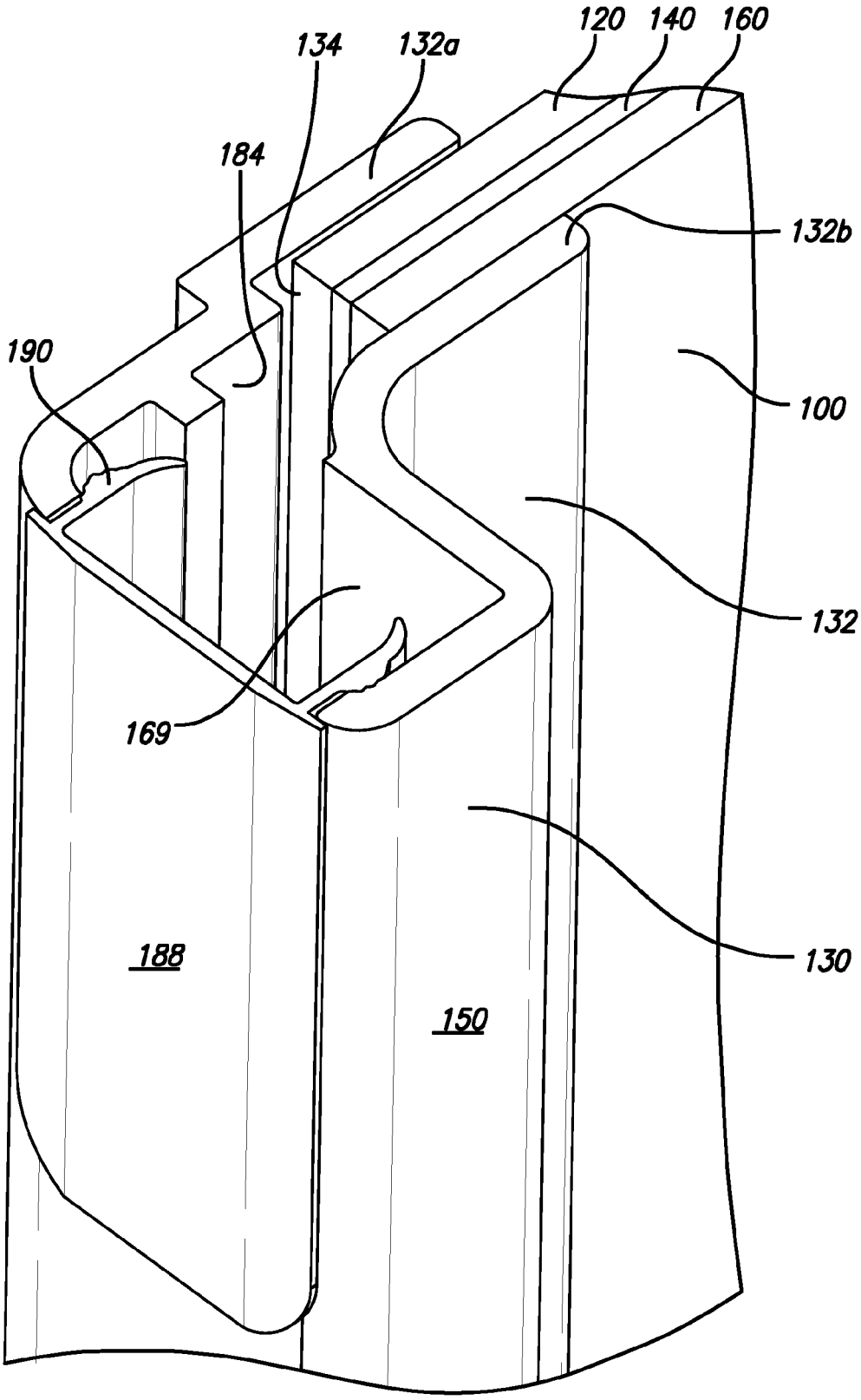
FIG. 12 is a cross sectional perspective view of the rail of the assembly of FIG. 1.
Figure 12A:
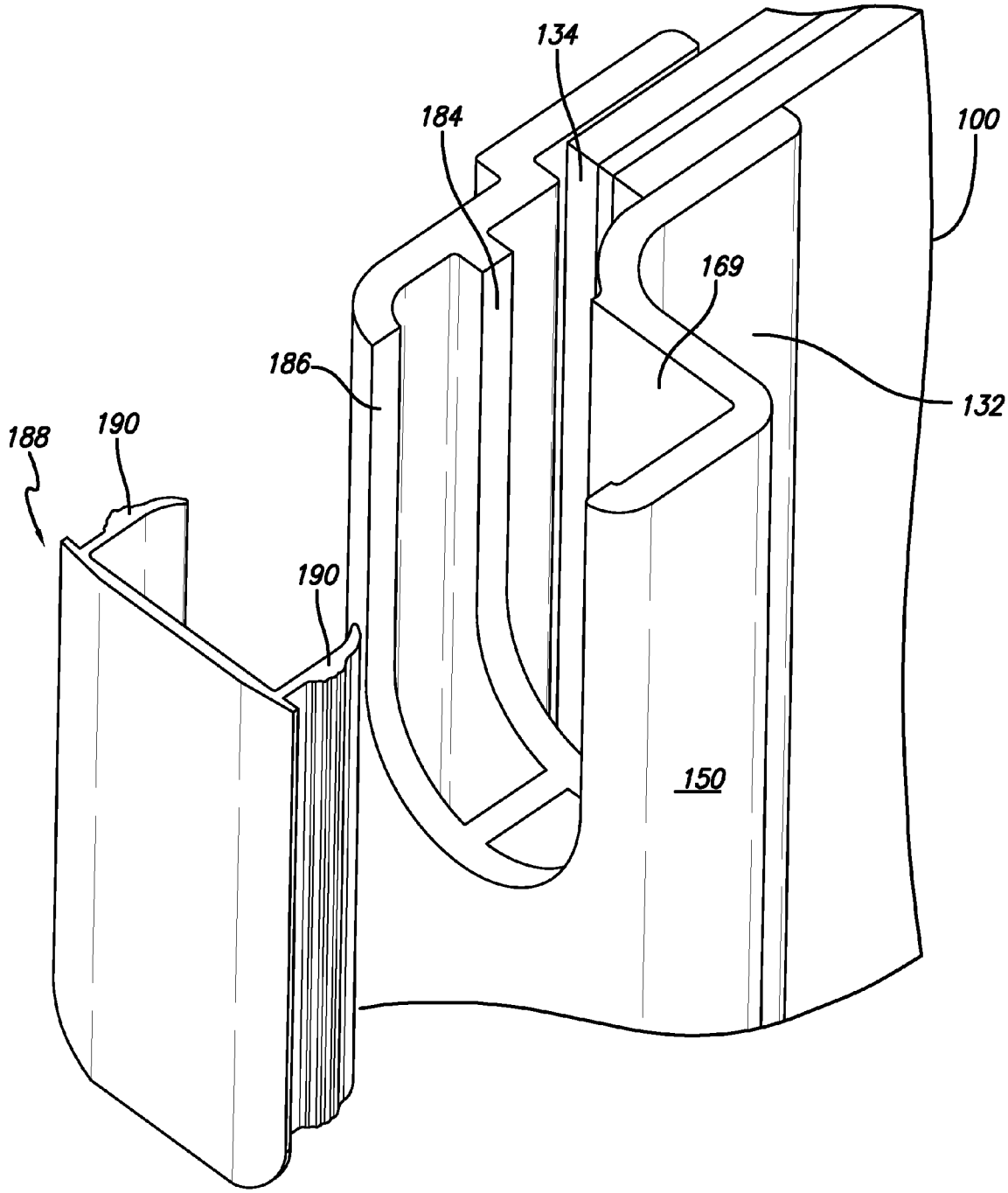
Figure 13:
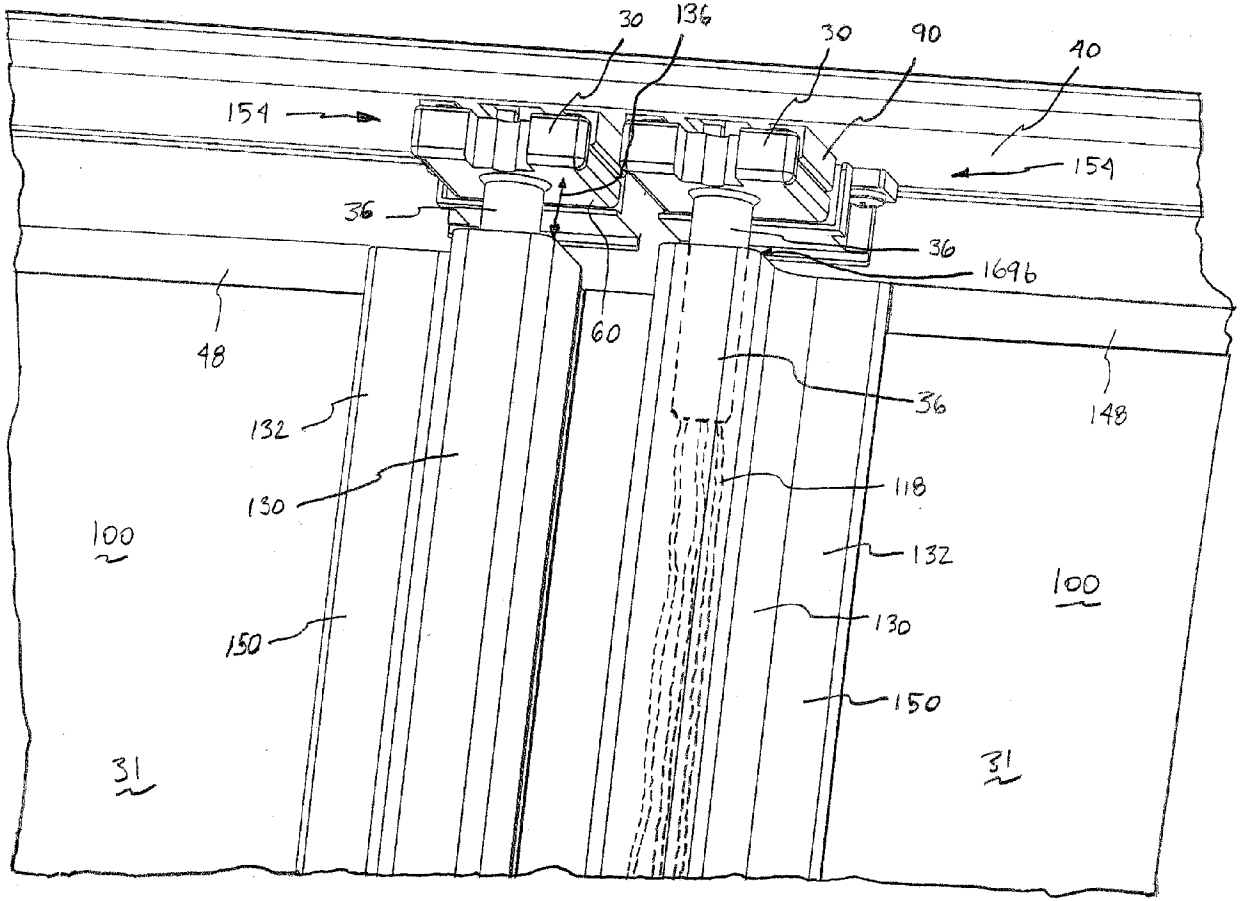
FIG. 13 is a partial interior perspective view of the assembly of FIG. 1 showing the electrical hinge pins and doors.

As shown in FIGS. 11-13, the SGU 100 is secured in a rail 150 that runs the vertical length of the door 31. The rail 150 includes openings **169*a* and 169*b* at the top and bottom thereof that receive hinge pins for hingedly connecting the door 31 to the frame 40. In a preferred embodiment, the door assembly includes a gravity hinge 152 at the bottom and an electrical hinge 154** at the top.

Figure 1:
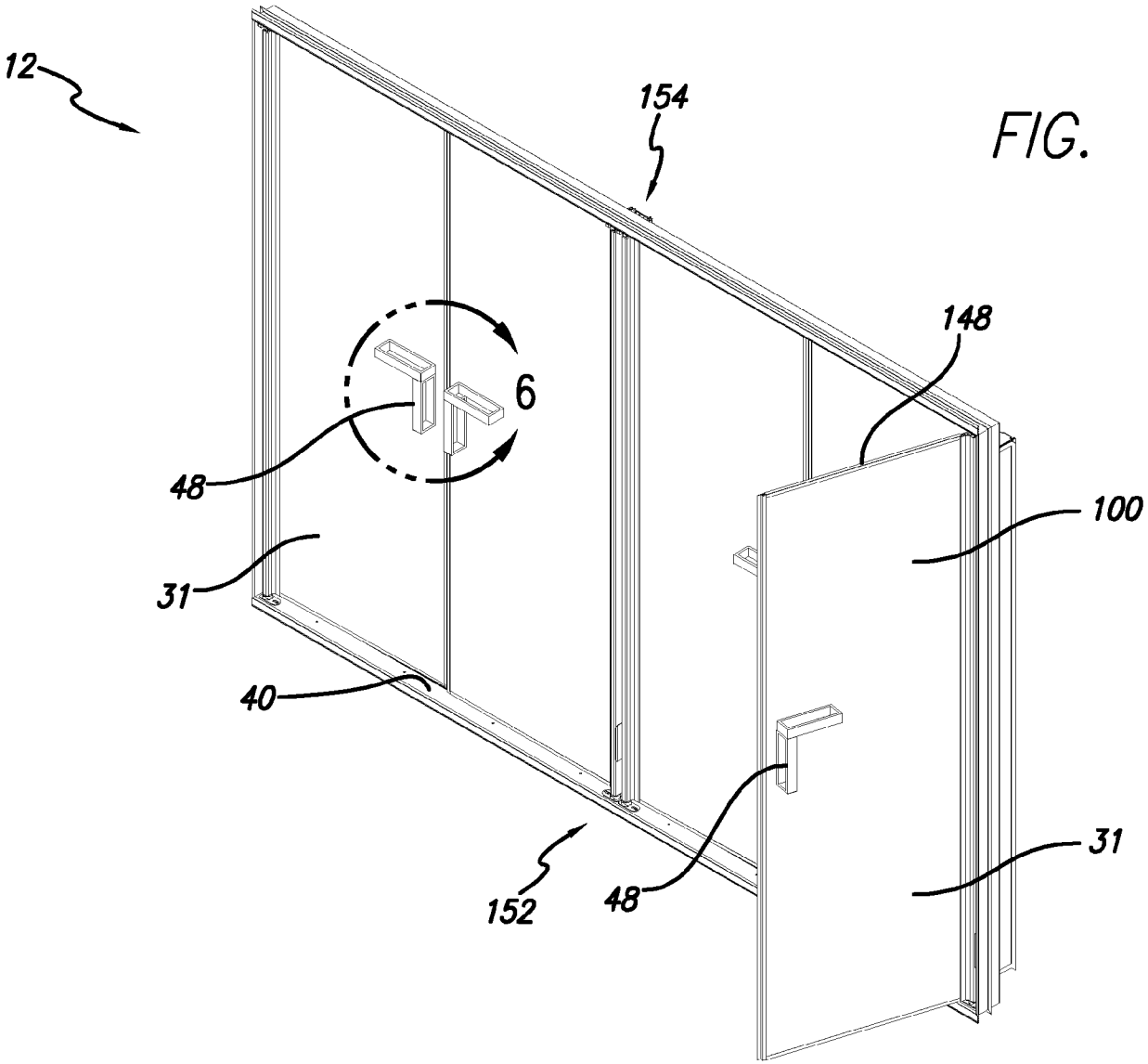
FIG. 1 is a perspective view of a refrigerated display case front assembly incorporating four display case doors in accordance with a preferred embodiment of the present invention.
Figure 2:
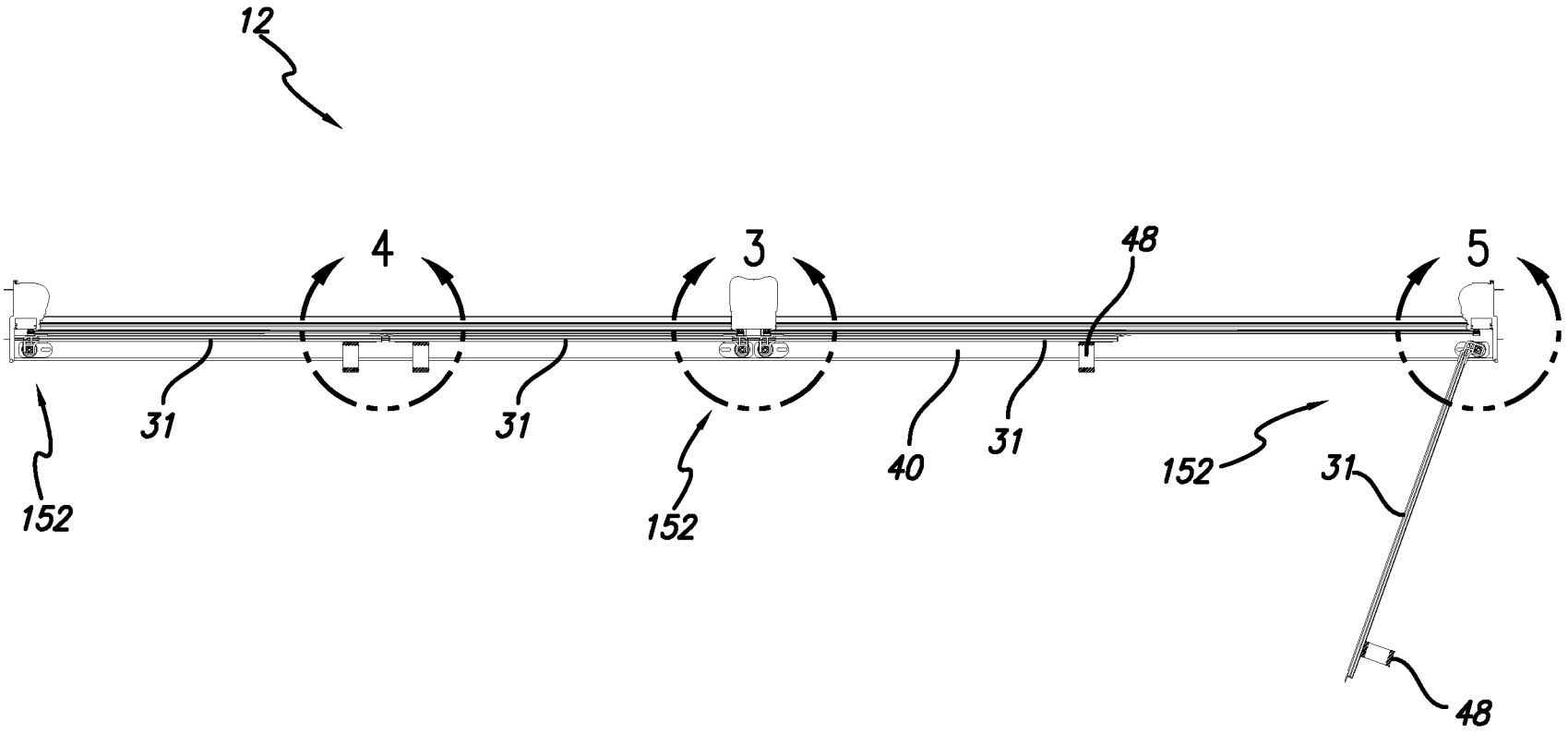
FIG. 2 is a cross-sectional view of the assembly of FIG. 1 taken along line 2-2 of FIG. 7.
Figure 3:
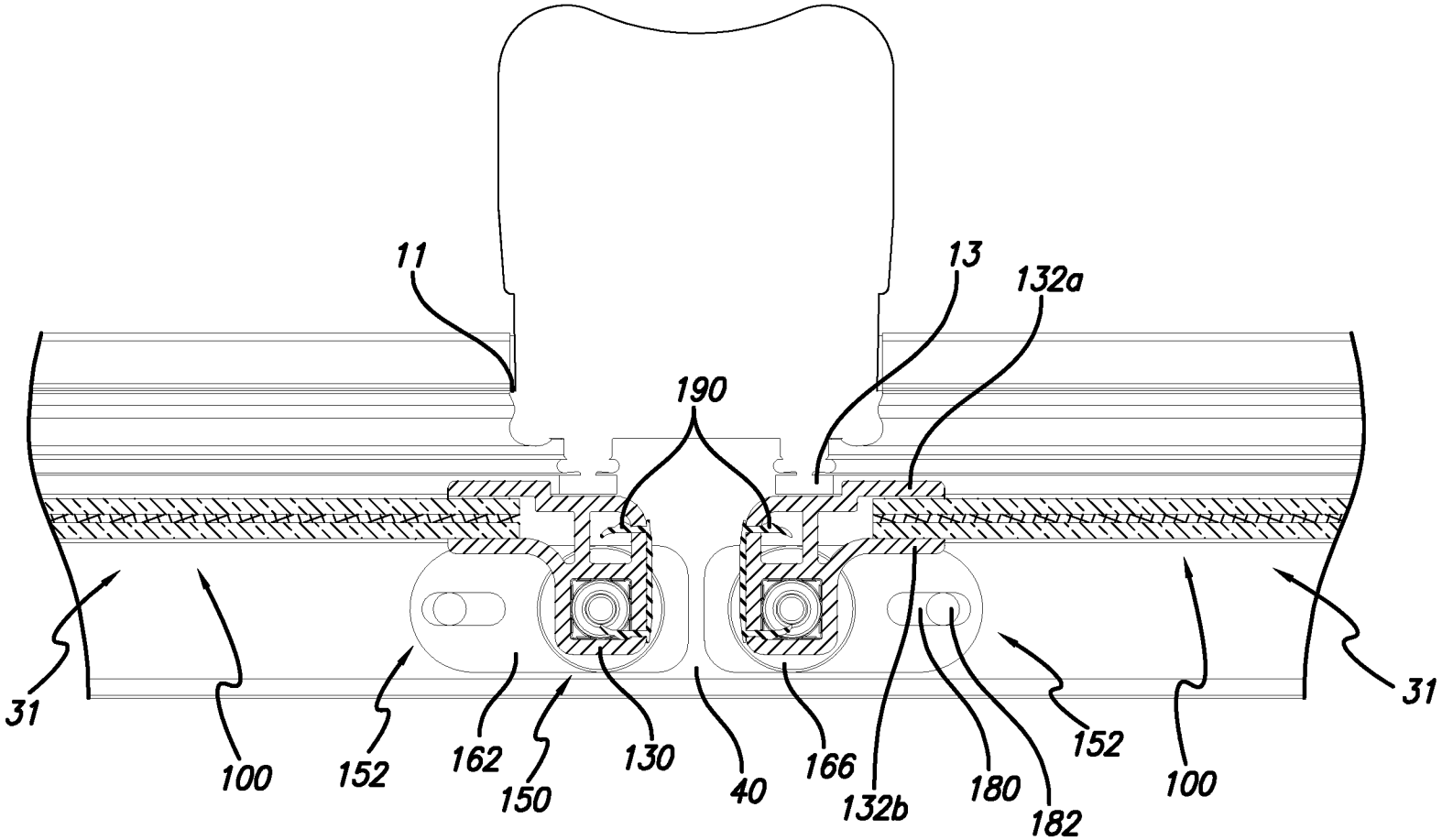
FIG. 3 is a detail taken from FIG. 2 as indicated.
Figure 4:
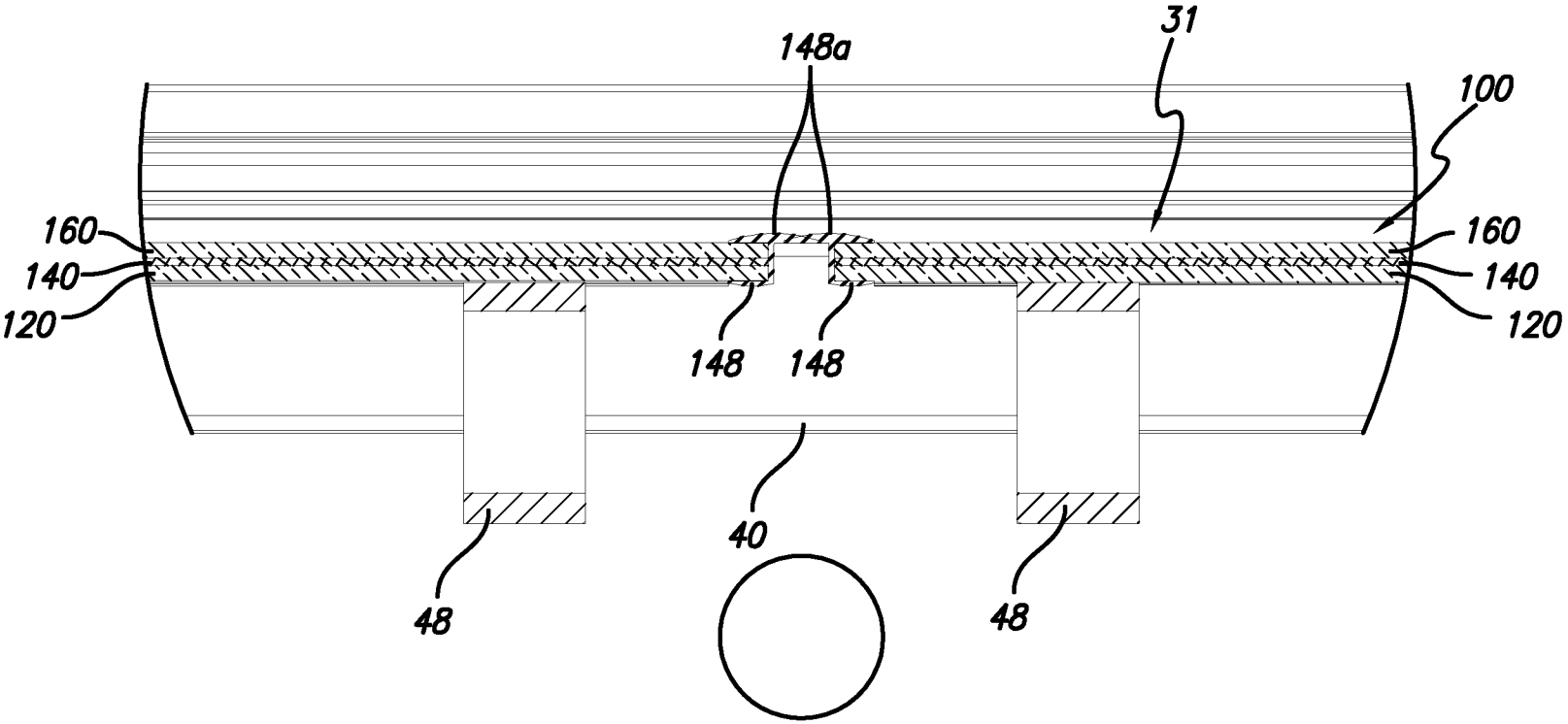
FIG. 4 is a detail taken from FIG. 2 as indicated.
Figure 5:
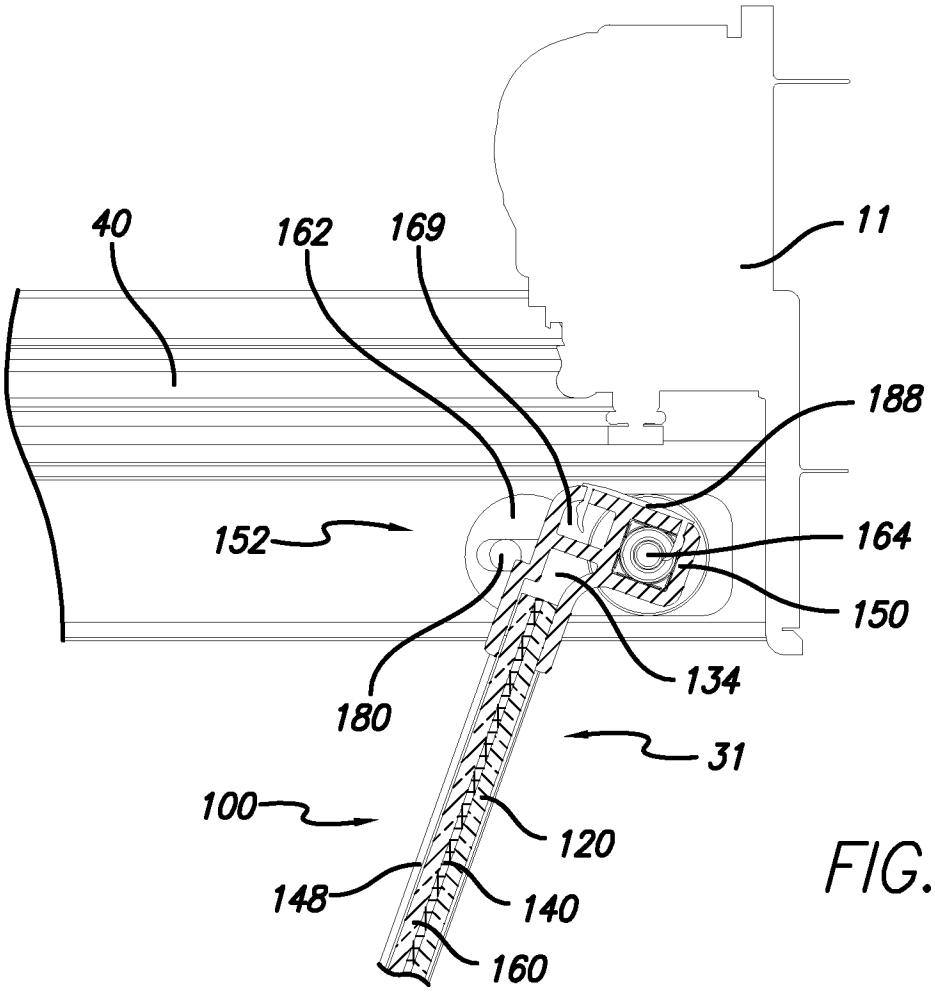
FIG. 5 is a detail taken from FIG. 2 as indicated.
Figure 6:
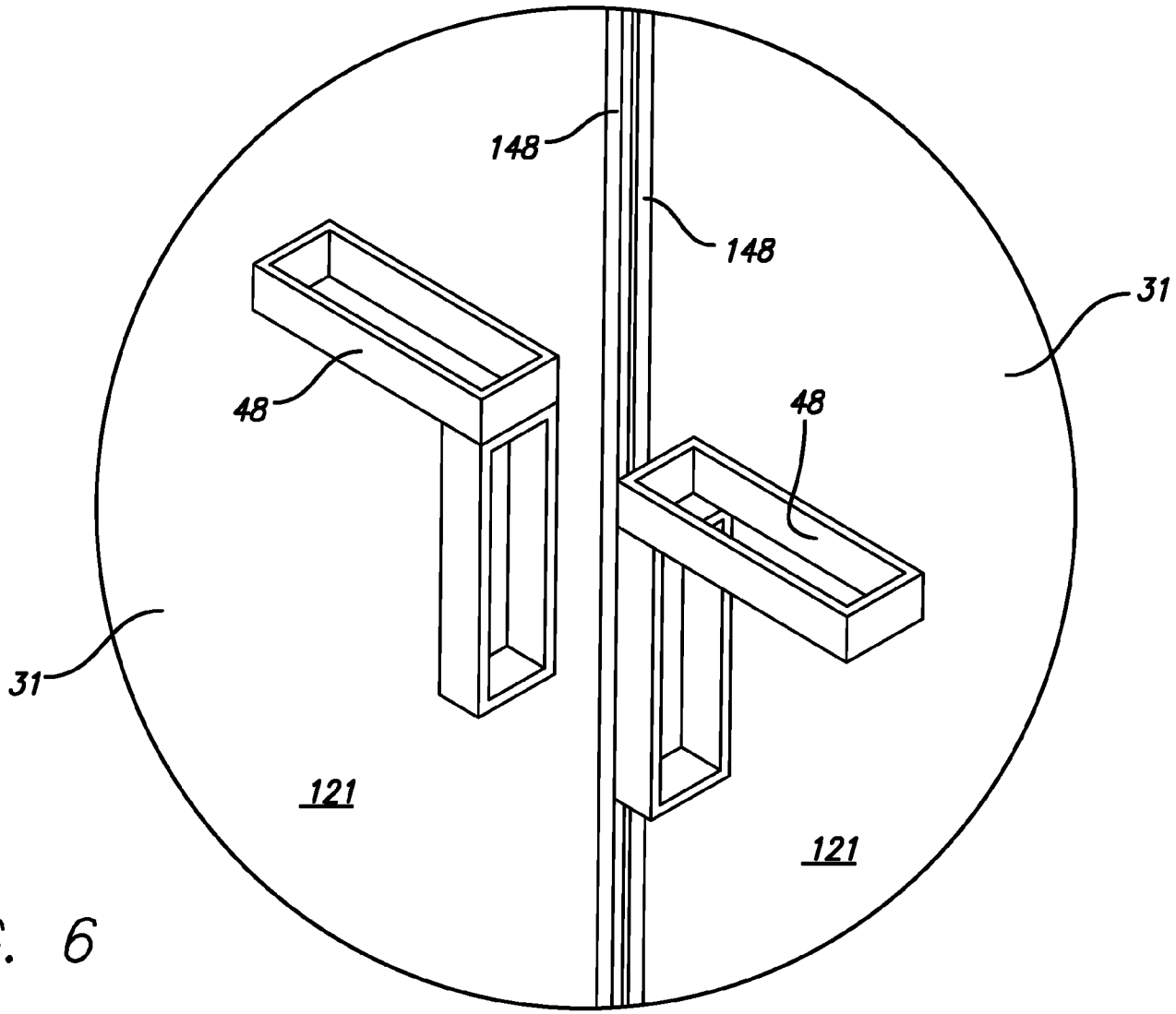
FIG. 6 is a detail taken from FIG. 1 as indicated.

As shown in FIG. 11 (cross section of door), the rail 150 preferably has a general "L" shape when viewed from the top or the bottom. The "L" shape is comprised of a hinge portion 130 and an SGU receiving portion 132 that includes opposing members 132*a* and 132*b* that define a channel 134 for receiving and securing the single glass unit 100. In a preferred embodiment, the rail is an aluminum extrusion into which the single glass unit 100 is bonded. It can be bonded with an adhesive, such as epoxy or polyurethane. A tape that incorporates an adhesive, such as acrylic or the like may also be used. Also, a mechanical clamp could be used to secure the SGU 100 in place. Combinations of a clamp and adhesives or tape could also be used. None of these are a limitation on the the present invention. In other embodiments, the rail 150 can be made of another material, such as stainless steel or other metal. As is best shown in FIG. 6, the handles 48 are preferably made from two rectangle extruded aluminum tubes that are cut to a specified dimension and bonded to surface 121 in a shape of a number "7" for a hinge left door 31 and mirrored for a hinge right door 31. However, this is not a limitation on the present invention and other handle configurations can be used.

With reference to FIGS. 14-17, those skilled in the art will appreciate the advantages of a gravity hinge, which generally includes a lower portion and an upper portion that rotates about an oblique junction upon the application of a rotational force. As the upper portion rotates, the two portions separate due to the oblique junction. The upper portion "rises" thereby storing potential energy which will cause the upper portion to "fall" or rotate back to a neutral position when the rotational force is terminated. Examples of gravity hinges are shown in U.S. Pat. No. 4,631,777 to Takimoto, U.S. Pat. No. 3,733,650 to Douglas and U.S. Pat. No. 4,991,259 to Finkelstein et al, the entireties of which are incorporated herein by reference.

The gravity hinge 152 of the preferred embodiment includes lower and upper portions 156 and 158. The lower portion 156 includes a plate 162 having an axial rod 164 extending upwardly therefrom. The upper portion 158 includes a collar 166 and a hinge pin 168 that are axially aligned and cooperate to define an opening 170 for receiving the axial rod 164 of the lower portion 156. The lower and upper portions 156 and 158 each include a cam track 156*a* and 158*a* thereon that cooperate as described below. To secure the door 31 on the gravity hinge 152, hinge pin 168 is received in opening 169*a* in the bottom of rail 150, and the rail 150 rests on collar 166. The opening 169*a* is the bottom of the tunnel 169 that extends the vertical length of the rail 150.

Figure 14:
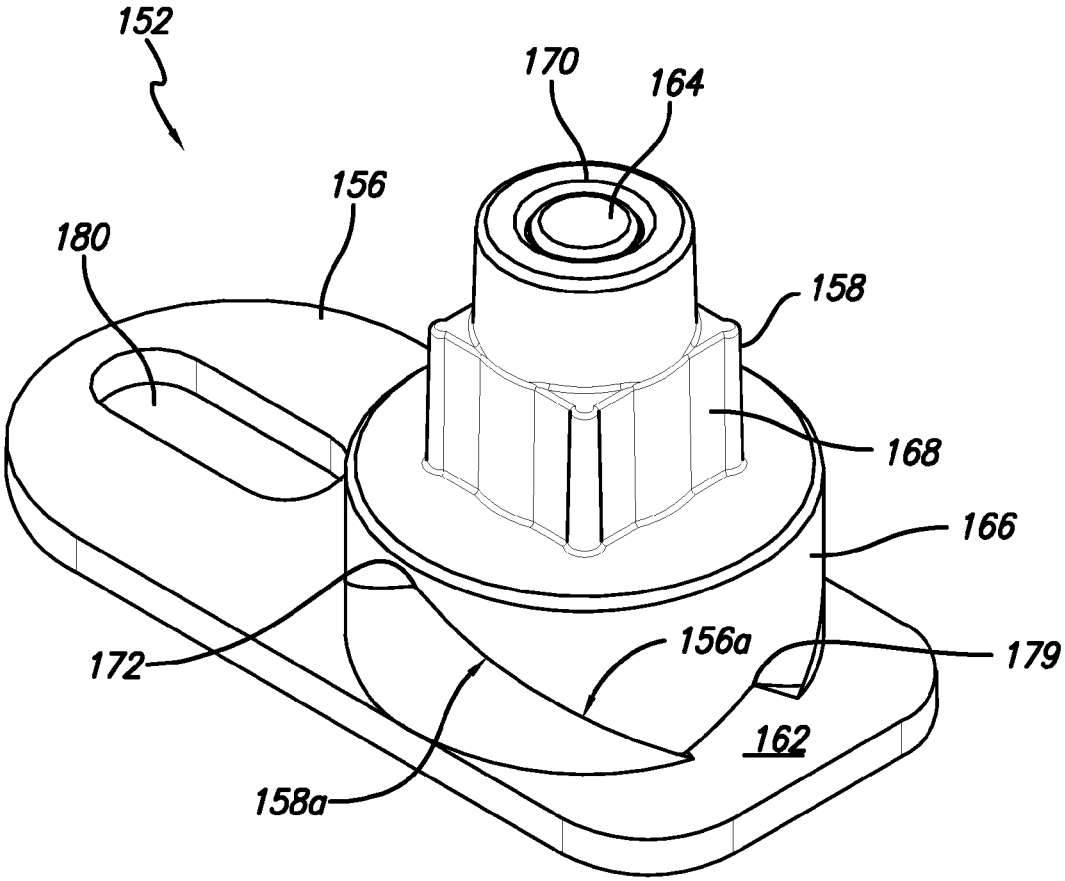
FIG. 14 is a perspective view of a gravity hinge in accordance with an embodiment of the invention.
Figure 15:
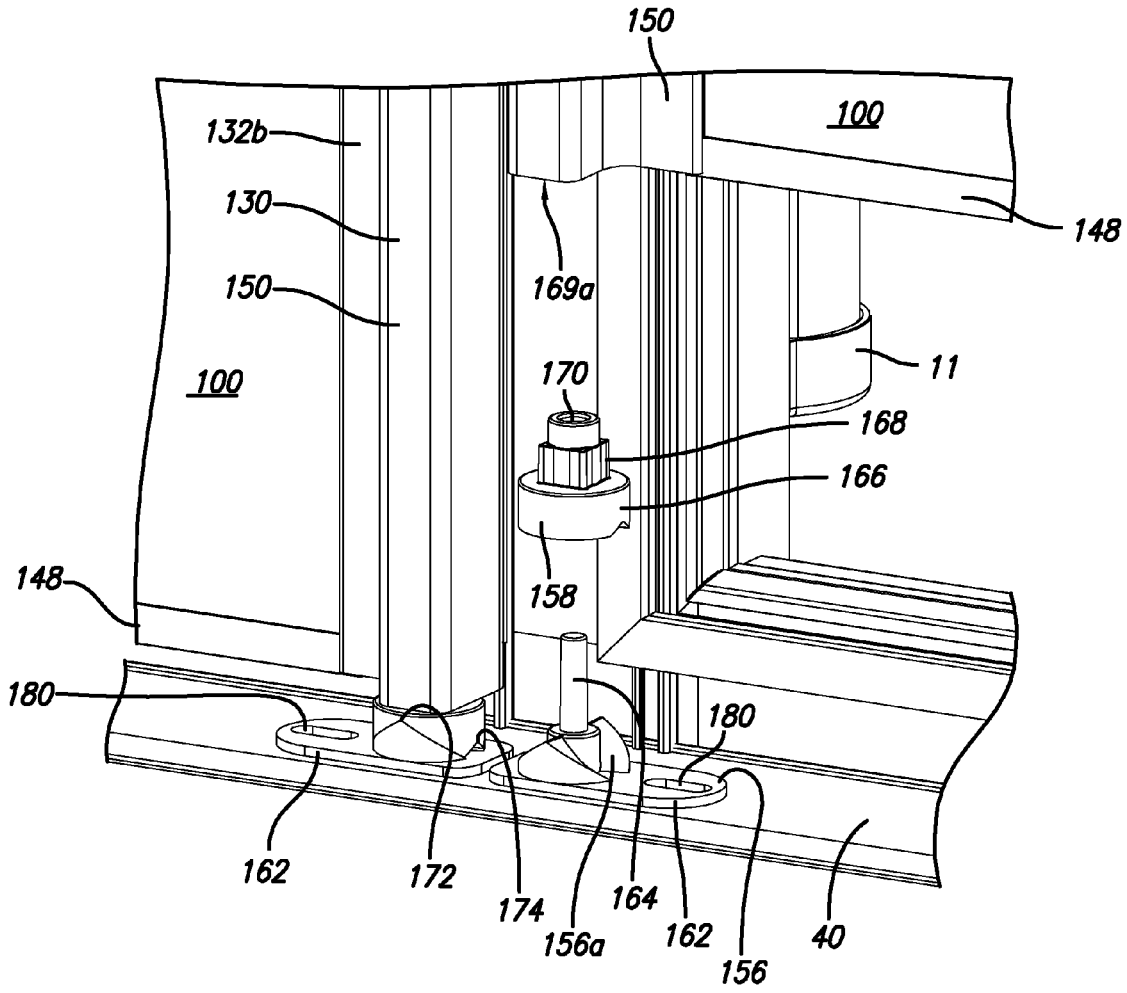
FIG. 15 is a partial interior perspective view of the assembly of FIG. 1 showing the gravity hinge exploded from the door and rail.
Figure 17:
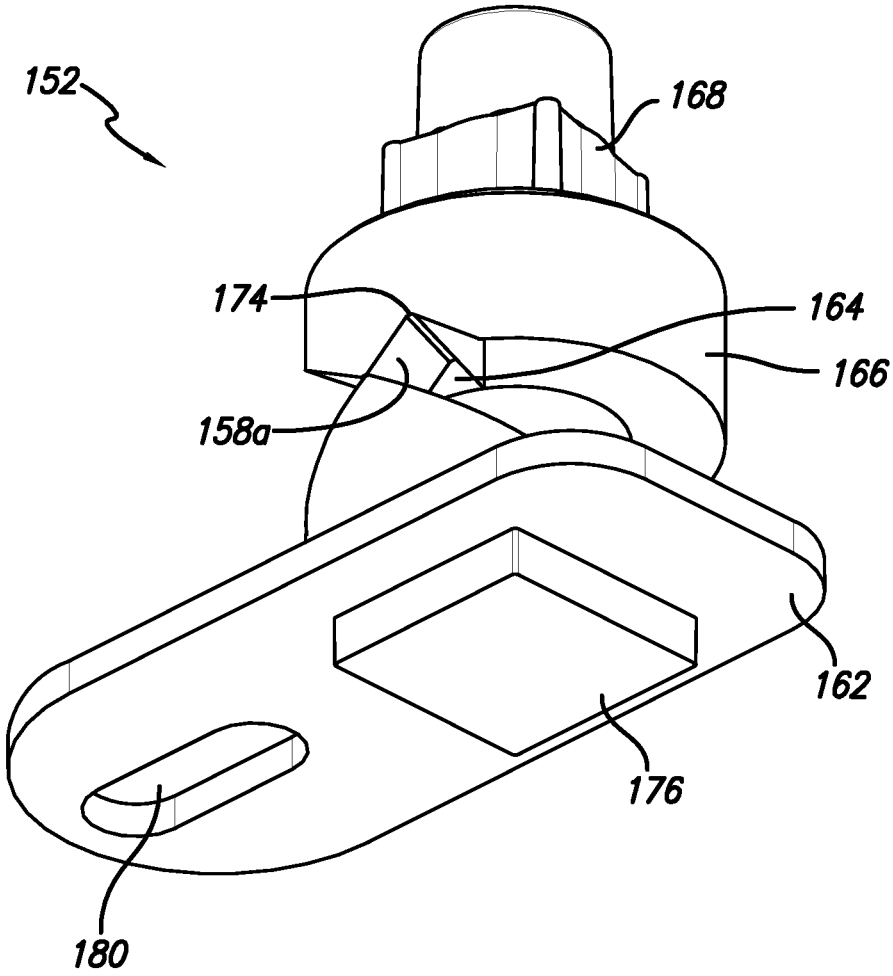
FIG. 17 is a bottom perspective view of the gravity hinge showing the upper portion before rotating back down to the closed position.

In a preferred embodiment, the gravity hinge 152 includes a hold open feature. As shown in FIG. 14, the cam track 158*a* on the upper portion 158 comprises two peaks 172 and 174, one corresponding to the door closed position 172 and the other corresponding to the door open position 174. These peaks or detents are sized to receive the lower portion's cam track 158*a*. FIG. 17, shows the gravity hinge 152 in the closed position. Preferably, the closed peak 172 extends vertically higher than the open peak 174. With this arrangement, when a user pushes the door from the open position toward the closed position, as a result of gravity and the potential energy stored when the door is in the open position, the door will fall to the closed position. FIG. 17 shows the gravity hinge 152 just as the upper portion 158 is about to fall to the closed position. As shown in the Figures, the peaks 172 and 174 are preferably located about 90° apart, which allows the door 31 to be held open at a position about perpendicular to the closed position. However, the open detent 174 can be defined at other angles about the collar 166, as desired.

Figure 16:
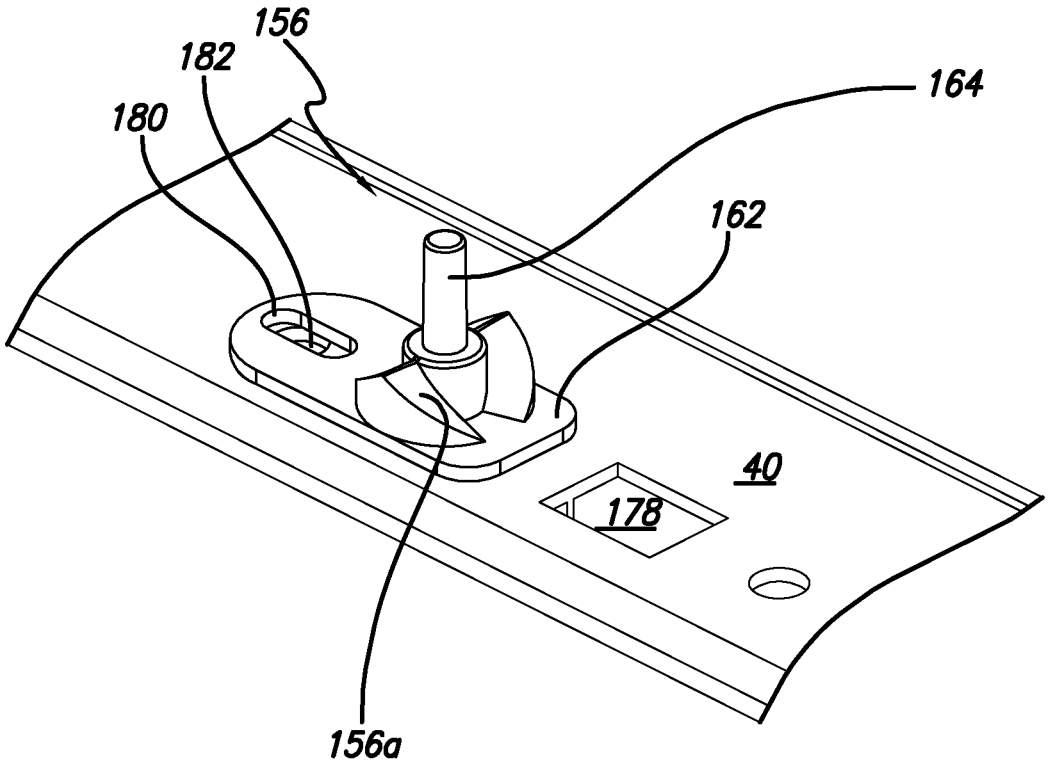
FIG. 16 is a perspective view of the lower portion of the gravity portion in the frame.

With reference to FIGS. 16-17, in a preferred embodiment, the plate 162 includes an alignment member 176 extending downwardly that is received into an alignment opening 178 in the frame 40. The plate 162 also has an elongated slot 180 defined therein. To secure the gravity hinge 152 to the frame 40, a threaded fastener, such as a riv nut or clinch nut (not shown) extends through slot 180 and is threaded into an opening 182 in the frame 40. The elongated slot 180 allows the gravity hinge 152 a degree of adjustability. This helps prevent door sag and helps keep the door 31 square or plumb as desired. It will be understood that the gravity hinge 152 can be secured to the frame 40 by other methods, such as welding, adhering, a threaded fastener with a nut, riveting, etc. In a preferred embodiment, the upper portion 158 is comprised of a molded nylon and the lower portion 156 is comprised of a metal, such as die cast zinc, stainless steel or the like.

Figure 18:
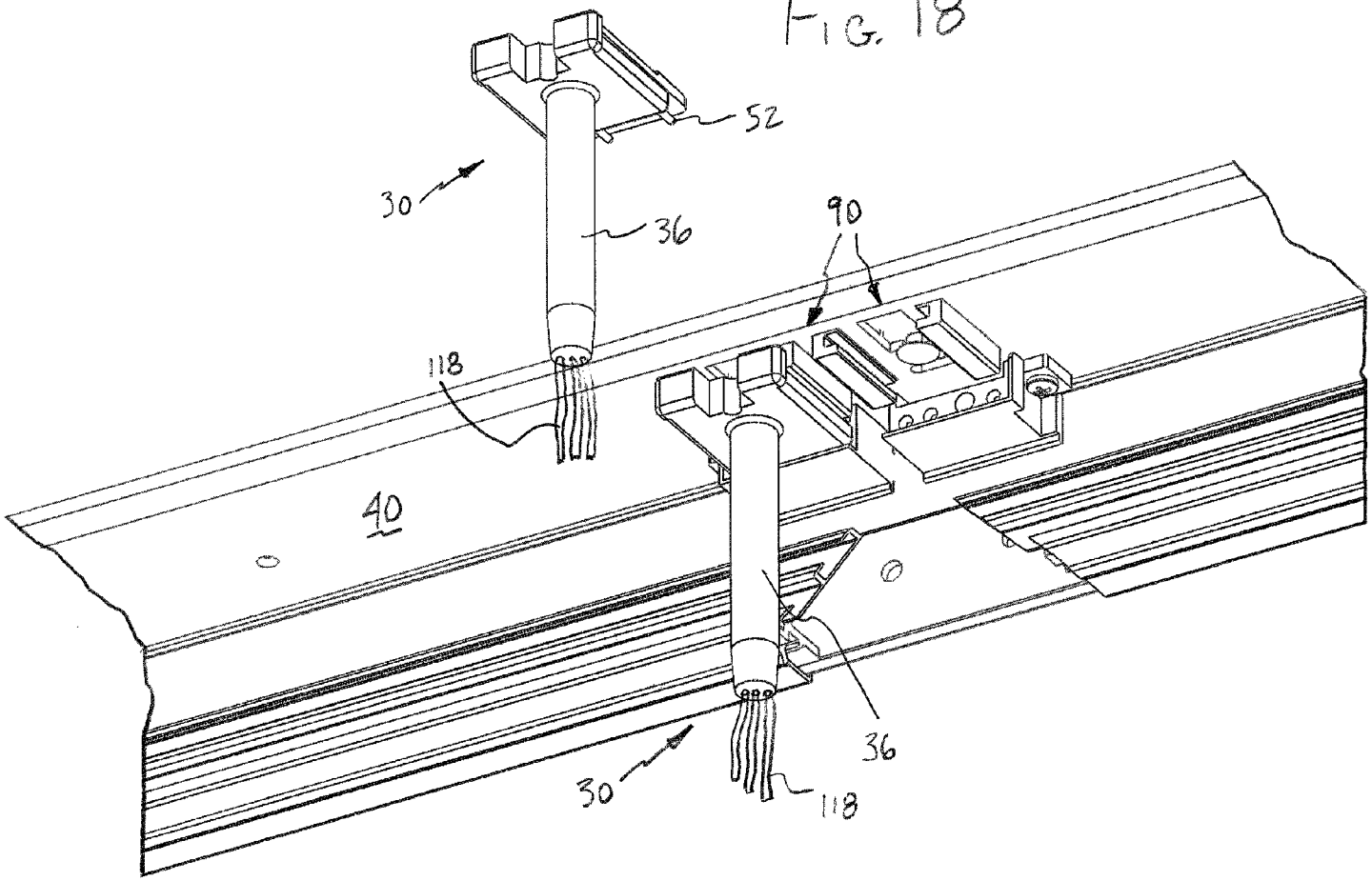
FIG. 18 is a perspective view showing two electrical hinge pins, with one exploded away from the female connector.

With reference to FIGS. 13 and 18, as discussed above, the assembly preferably includes an electrical or plug in hinge pin 154 at the top thereof. For example, the electrical hinge pin can be that taught in U.S. Pat. No. 4,671,582 (referred to herein as the "'582 patent"), titled combined plug-in hinge pin and double ended electrical connector for a hinged appliance door, with mating receptacle and connectors, issued Jun. 9, 1987, the entirety of which is incorporated herein by reference. As shown in FIG. 18, the components numbered, such as the combined plug-in hinge pin and double-ended electrical plug assembly 30, hinge pin part 36, male contact pin members 52, and female connector assembly 90 are numbered the same as in the figures of the '582 patent.

In a preferred embodiment, there is a gap 136 between the top of rail 150 and the frame. As shown in FIG. 13, the gap is more specifically between the rail and reinforcing member 60 (part of the male connection portion of the electrical hinge pin 154). This gap 136 allows the door 31 to travel up and down as a result of the cam action of the gravity hinge 152.

As shown in FIG. 13, the electrical hinge pin 154 includes a hinge pin part 36 that extends downwardly into the top opening 169*b* of tunnel 169. Therefore, hinge pin part 36 and hinge pin 168 are coaxial (as a result of both extending into tunnel 169) and allow door 31 to pivot. The hinge pin part 36 houses insulated conductors 118 that extend out of the bottom of hinge pin part 36 and into tunnel 169. As shown in FIG. 11, which is a cross section of the door 31, the rail 150 includes a conductor opening 184 defined therein that provides communication between the tunnel 169 and channel 134. To provide electrical power to the SGU 100, power runs from a wall outlet or the like, through wiring hidden in the frame, through the electrical hinge pin down wires 118 extending down the tunnel 169, through the conductor opening 184, into channel 134 and to the solder tabs 146 and bus bars 142 and 144. With this arrangement, all of the wires necessary to provide electrical power to the electro-conductive coating are hidden from view of a consumer.

In a preferred embodiment, the rail 150 also includes wire access opening 186 that opens to the outside of the rail 150. In this embodiment, wires 118 from the electrical hinge pin 154 pass down tunnel 169 to opening 186, and wires 118 from the top and bottom bus bars 142 and 144 pass down channel 134, through opening 184 to opening 186 where, during assembly, electrical connections between the wires can be made externally. Once the electrical hinge pin 184 and SGU 100 lead connections are made, the wires 118 are placed back into the rail 150 and an access cover 188 is inserted in the wire access hole 186 to conceal the connections. The access cover 188 is preferably made of plastic or the like and includes tabs 190 that secure it within the opening 186 via a snap fit.

Figure 19:
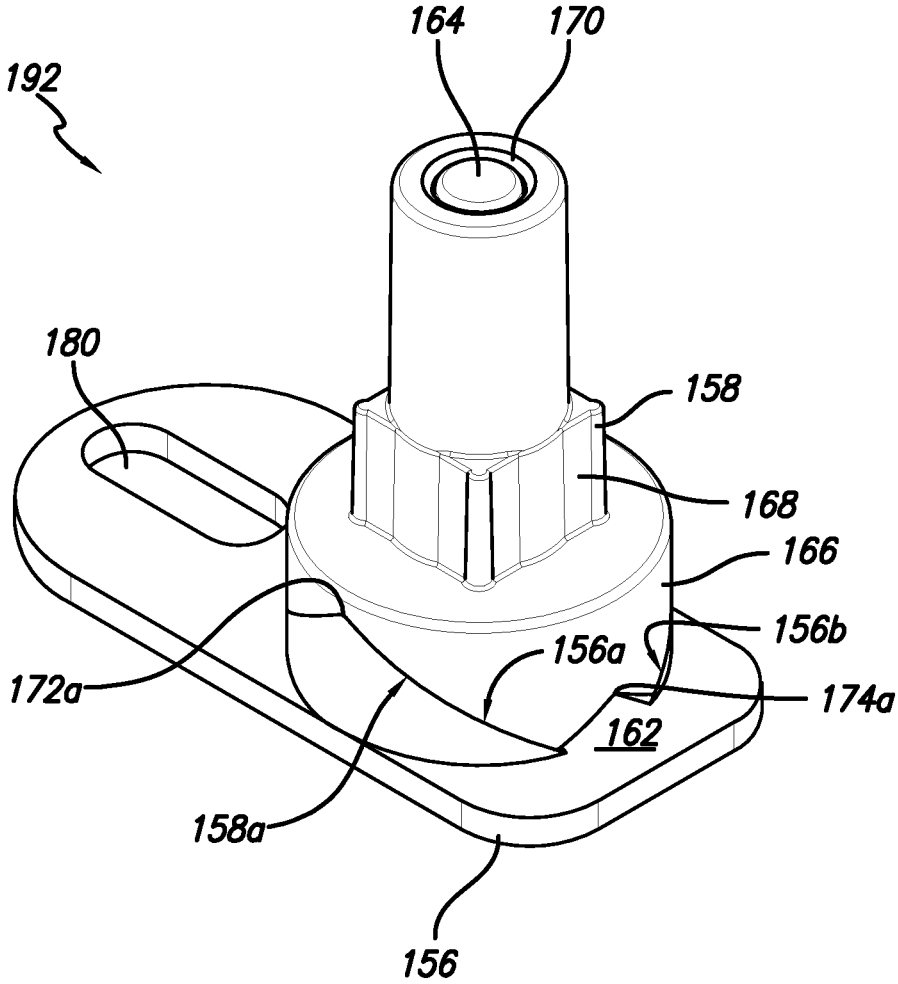
FIG. 19 is a perspective view of a gravity hinge in accordance with another embodiment of the invention.
Figure 20:
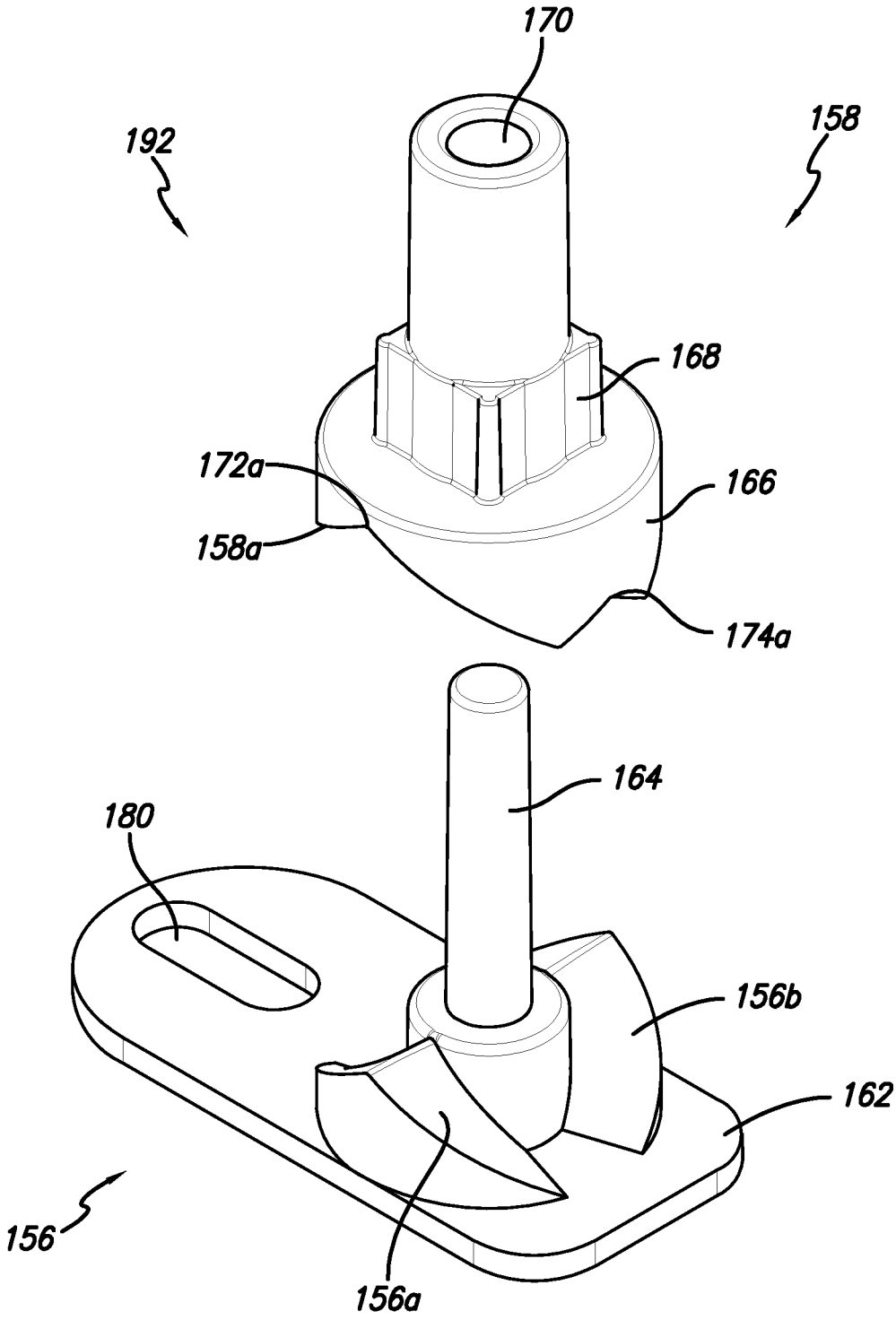
FIG. 20 is a top exploded perspective view of the gravity hinge of FIG. 19.
Figure 21:
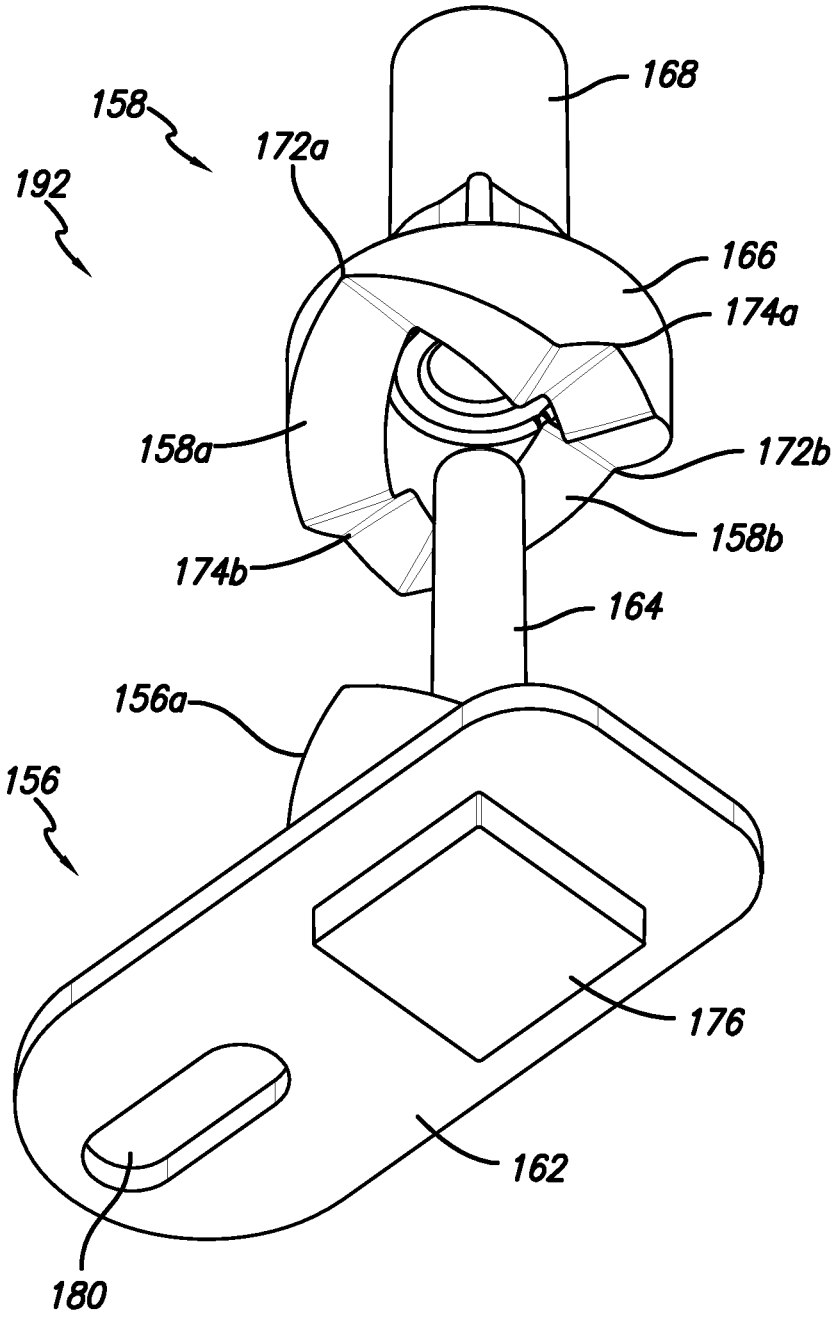
FIG. 21 is a bottom exploded perspective view of the gravity hinge of FIG. 19.

With reference to FIGS. 19-21, another embodiment of a gravity hinge 192 is shown. This gravity hinge 192 is similar to the gravity hinge 152 described above, except that the lower and upper portions 156 and 158 each include dual or first and second cam tracks 156*a*, 156*b* and 158*a* thereon. As shown in FIG. 21, the cam tracks 158*a* and 158*b* on the upper portion 158 each comprise two peaks 172*a*, 172*b* and 174*a*, 174*b*, two corresponding to the door closed position 172*a*, 172*b* and the others corresponding to the door open position 174*a*, 174*b*. These peaks or detents are sized to receive the lower portion's cam tracks 158*a* and 158*b*. FIG. 19, shows the gravity hinge 192 in the closed position. Preferably, the closed peaks 172*a*, 172*b* extend vertically higher than the open peaks 174*a*, 174*b*. With this arrangement, when a user pushes the door from the open position toward the closed position, as a result of gravity and the potential energy stored when the door is in the open position, the door will fall to the closed position. As shown in the Figures, in a preferred embodiment, the closed peaks 172*a*, 172*b* are about 180° apart. Also, the open peaks 174*a*, 174*b* are about 180° apart. This helps distribute the weight or load of the door and helps prevent door sag, damage, wear and tear, etc.

It will be understood by those skilled in the art that all of the components of the assembly 12, including the door 31 (the SGU 100, rail 150, etc.), gravity hinges 152 or 192 and electrical hinge pin 154, among others, are all reversible and can be used on left hinge and right hinge doors 31. For example, see FIG. 15, which shows the same configuration gravity hinge 152 for left hinge and right hinge doors. In another embodiment, the components of the upper and lower portions 156, 158 of the gravity hinges can be reversed such that the concave portions of the cam track are on the lower portion, the convex portions of the cam track are on the upper portion and the axial rod extends from the upper portion, etc.

The embodiments described above are exemplary embodiments of a the present invention. Those skilled in the art may now make numerous uses of, and departures from, the above-described embodiments without departing from the inventive concepts disclosed herein Accordingly, the present invention is to be defined solely by the scope of the following claims.

The invention claimed is:

1. A door assembly comprising:

a) a frame having an upper portion and a lower portion;

b) an electrical hinge mounted to the upper portion of the frame, wherein the electrical hinge has a hinge pin part having a plurality of electrical conductors extending downwardly therefrom;

c) a bottom hinge mounted to the lower portion of the frame, wherein the bottom hinge has a hinge pin part, and d) at least a first door pivotably mounted to the frame about a pivot axis by the electrical hinge and the bottom hinge, wherein the door comprises i) a laminated package having first, second and third layers adhered to one another, wherein at least one of the layers includes an electro-conductive coating thereon, wherein the electro-conductive coating is in electrical communication with the electrical hinge, wherein the laminated package has a top edge, a bottom edge, a hinge side edge and a non-hinge side edge, and ii) a rail secured adjacent the hinge side edge of the laminated package, wherein the rail includes a tunnel defined therein that includes a top opening and a bottom opening, wherein the top opening receives the hinge pin part of the electrical hinge and the bottom opening receives the hinge pin part of the bottom hinge, wherein the rail includes a hinge portion and a laminated package receiving portion that includes opposing members that sandwich and secure a portion of the first, second and third layers of the laminated package therebetween, wherein at least one of the top edge, bottom edge, and non-hinge side edge is free of any structural frame member that secures a portion of the first, second and third layers of the laminated package therebetween.

2. The door assembly of claim 1 wherein the first, second and third layers each include front and back surfaces and wherein the electro-conductive coating is on the back surface of the first layer.

3. The door assembly of claim 2 wherein the first and third layers are comprised of glass and the second layer is comprised of plastic.

4. The door assembly of claim 3 wherein the back surface of the first layer includes top and bottom bus bars secured thereto, wherein the top and bottom bus bars include conductors that extend from the hinge side edge of the laminated package, and wherein the top and bottom bus bars are in electrical communication with the electro-conductive coating and the electrical hinge.

5. The door assembly of claim 1 wherein the opposing members and the hinge side edges of the first, second and third layers of the laminated package define a channel that extends from the top to the bottom of the rail, wherein the rail includes a wall that separates the channel and the tunnel and a conductor opening defined in the wall that communicates the channel and the tunnel, and wherein the electrical conductors extend from the electrical hinge, down the tunnel, through the conductor opening, into the channel and to the top and bottom bus bars.

6. The door assembly of claim 1 wherein the rail further includes a wire access opening defined therein that communicates the tunnel with the exterior of the rail, wherein the wire access opening is covered by a removable access cover.

7. The door assembly of claim 1 wherein the top edge, bottom edge, and non-hinge side edge of the laminated package each have a transparent edge guard thereon.

8. The door assembly of claim 7 wherein the transparent edge guard on the non-hinge side edge comprises a first portion attached to the first layer, a second portion attached to the non-hinge side edge and a third portion attached to the third layer, and wherein the transparent edge guard includes a wiper extending outwardly from the second portion.

9. The door assembly of claim 1 wherein the laminated package includes first and second outer surfaces that define first and second parallel planes, and wherein the pivot axis is not positioned between the first and second parallel planes extended.

10. The door assembly of claim 1 wherein the rail forms a general L-shape such that the pivot axis is offset from the laminated package.

11. A door assembly comprising:

a) a frame having an upper portion and a lower portion;

b) first and second electrical hinges mounted to the upper portion of the frame, wherein the first and second electrical hinges each have a hinge pin part having a plurality of electrical conductors extending downwardly therefrom;

c) first and second bottom hinges mounted to the lower portion of the frame, wherein the first and second bottom hinges each have a hinge pin part, and d) a first door pivotably mounted to the frame about a first pivot axis by the first electrical hinge and the first bottom hinge, wherein the first door comprises i) a laminated package having first, second and third layers adhered to one another, wherein the first, second and third layers each include front and back surfaces and wherein an electro-conductive coating is disposed on the back surface of the first layer, wherein the electro-conductive coating is in electrical communication with the electrical hinge, wherein the first and third layers are comprised of glass and the second layer is comprised of plastic, wherein the laminated package has a top edge, a bottom edge, a hinge side edge and a non-hinge side edge, wherein the back surface of the first layer includes top and bottom bus bars secured thereto, wherein the top and bottom bus bars include conductors that extend from the hinge side edge of the laminated package, and wherein the top and bottom bus bars are in electrical communication with the electro-conductive coating and the first electrical hinge, wherein the top edge, bottom edge, and non-hinge side edge of the laminated package each have a transparent edge guard thereon, wherein the transparent edge guard on the non-hinge side edge comprises a first portion attached to the first layer, a second portion attached to the non-hinge side edge and a third portion attached to the third layer, and wherein the transparent edge guard includes a first wiper extending outwardly from the second portion, and ii) a rail secured adjacent the hinge side edge of the laminated package, wherein the rail includes a tunnel defined therein that includes a top opening and a bottom opening, wherein the top opening receives the hinge pin part of the electrical hinge and the bottom opening receives the hinge pin part of the bottom hinge, wherein the rail includes a hinge portion and a laminated package receiving portion that includes opposing members that sandwich and secure a portion of the first, second and third layers of the laminated package therebetween, wherein the laminated package includes first and second outer surfaces that define first and second parallel planes, and wherein the first and second pivot axes are not positioned between the first and second parallel planes extended, wherein at least one of the top edge, bottom edge, and non-hinge side edge is free of any structural frame member that secures a portion of the first, second and third layers of the laminated package therebetween e) a second door pivotably mounted to the frame about a second pivot axis by the second electrical hinge and the second bottom hinge, wherein the second door comprises i) a laminated package having first, second and third layers adhered to one another, wherein the first, second and third layers each include front and back surfaces and wherein an electro-conductive coating is disposed on the back surface of the first layer, wherein the electro-conductive coating is in electrical communication with the electrical hinge, wherein the first and third layers are comprised of glass and the second layer is comprised of plastic, wherein the laminated package has a top edge, a bottom edge, a hinge side edge and a non-hinge side edge, wherein the back surface of the first layer includes top and bottom bus bars secured thereto, wherein the top and bottom bus bars include conductors that extend from the hinge side edge of the laminated package, and wherein the top and bottom bus bars are in electrical communication with the electro-conductive coating and the second electrical hinge, wherein the top edge, bottom edge, and non-hinge side edge of the laminated package each have a transparent edge guard thereon, wherein the transparent edge guard on the non-hinge side edge comprises a first portion attached to the first layer, a second portion attached to the non-hinge side edge and a third portion attached to the third layer, and wherein the transparent edge guard includes a second wiper extending outwardly from the second portion, and ii) a rail secured adjacent the hinge side edge of the laminated package, wherein the rail includes a tunnel defined therein that includes a top opening and a bottom opening, wherein the top opening receives the hinge pin part of the electrical hinge and the bottom opening receives the hinge pin part of the bottom hinge, wherein the rail includes a hinge portion and a laminated package receiving portion that includes opposing members that sandwich and secure a portion of the first, second and third layers of the laminated package therebetween, wherein the laminated package includes first and second outer surfaces that define first and second parallel planes, and wherein the first and second pivot axes are not positioned between the first and second parallel planes extended wherein at least one of the top edge, bottom edge, and non-hinge side edge is free of any structural frame member that secures a portion of the first, second and third layers of the laminated package therebetween.

* * * * *